US007311380B2

(12) United States Patent
Watanabe et al.

(10) Patent No.: US 7,311,380 B2
(45) Date of Patent: Dec. 25, 2007

(54) INKJET HEAD

(75) Inventors: Hidetoshi Watanabe, Tokoname (JP); Atsushi Hirota, Nagoya (JP); Tadanobu Chikamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/669,854

(22) Filed: Sep. 25, 2003

(65) Prior Publication Data

US 2004/0130594 A1 Jul. 8, 2004

(30) Foreign Application Priority Data

Sep. 26, 2002 (JP) ..... 2002-281306
Sep. 26, 2002 (JP) ..... 2002-281327

(51) Int. Cl.
*B41J 2/15* (2006.01)
*B41J 2/145* (2006.01)

(52) U.S. Cl. ..... 347/40; 347/65; 347/71

(58) Field of Classification Search ..... 347/68, 347/40, 65, 71
See application file for complete search history.

(56) References Cited

U.S. PATENT DOCUMENTS

| | | | | |
|---|---|---|---|---|
| 4,521,788 | A | 6/1985 | Kimura et al. | |
| 5,157,420 | A | 10/1992 | Naka et al. | |
| 5,818,482 | A | 10/1998 | Ohta et al. | |
| 5,907,338 | A * | 5/1999 | Burr et al. | 347/43 |
| 6,206,501 | B1 * | 3/2001 | Ishii et al. | 347/40 |
| 6,604,817 | B2 | 8/2003 | Isono et al. | |
| 2002/0042994 | A1 | 4/2002 | Ito et al. | |

FOREIGN PATENT DOCUMENTS

| | | |
|---|---|---|
| EP | 0 413 340 A1 | 2/1991 |
| JP | A 4-235057 | 8/1992 |
| JP | A 5-338149 | 12/1993 |
| JP | B2 2718010 | 11/1997 |
| JP | A 9-314832 | 12/1997 |
| JP | A 2000-25218 | 1/2000 |
| JP | A-2000-25219 | 1/2000 |
| JP | A 2000-263786 | 9/2000 |
| JP | A-2001-246744 | 9/2001 |
| JP | A 2001-277496 | 10/2001 |
| JP | A-2002-127406 | 5/2002 |
| JP | A-2002-134155 | 8/2002 |
| JP | A-2002-234155 | 8/2002 |
| JP | A 2002-234170 | 8/2002 |

* cited by examiner

*Primary Examiner*—Thinh Nguyen
(74) *Attorney, Agent, or Firm*—Oliff & Berridge, PLC

(57) ABSTRACT

An inkjet head is composed of a plurality of plates stacked on each other. The plurality of plates includes a cavity plate formed with a plurality of ink pressure chambers and a plurality of manifold plates for forming a manifold chamber being in fluid communication with the ink pressure chambers to distribute ink thereamong. Each manifold plate is provided with an opening formed therethrough with a portion thereof being left in the opening. When the manifold chambers are stacked on each other, the openings of the manifold plates formed as above constitute a manifold channel taking the form of a closed loop. The portions of the manifold plates left in the openings are supported by a plurality of beams formed on the manifold plates. The beams are thinner than respective manifold plates, and are arranged so as not to overlap each other when viewed in a direction the manifold plates are stacked.

26 Claims, 31 Drawing Sheets

INKJET HEAD

BACKGROUND OF THE INVENTION

1. Field of Invention

The present invention relates to an inkjet head for printing images/characters on a recording medium, and more particularly to an inkjet head including a common ink chamber for distributing ink to a plurality of ink pressure chambers.

2. Description of Related Art

FIG. 1 schematically shows a conventional ink flow channel formed in an inkjet head, which is disclosed in Japanese Patent Application Provisional Publication No. P2001-277496. The ink flow channel includes a plurality of ink pressure chambers 1020 connected to a common ink chamber 1026 through respective ink supply channels 1027. Ink to be ejected from the inkjet head is first introduced into the common ink chamber 1026 through an ink supply tube 1035 and then distributed therefrom to each ink pressure chamber 1020. The ink in each ink pressure chamber 1020 is selectively pressurized and thereby ejected from a nozzle 1013 which is in fluid communication with the pressure chamber 1020.

When pressure is repeatedly applied to the ink in one or more ink pressure chambers 1020, pressure waves transmit from the ink pressure chambers 1020 into the common ink chamber 1026 through the ink supply channels 1027. The pressure waves are partially reflected at closed ends 1026*a* of the common ink chamber 1026, such that the traveled pressure waves and the reflected pressure waves are superimposed. The superimposed pressure waves partially transmit through the ink supply channels 1027 to increase/decrease the pressure within the pressure chambers 1026. Such unintentional increase/decrease of the pressure within the pressure chambers 1026 causes increase/decrease of the amount of the ink ejected from the nozzles as well as breakage of the ink meniscuses formed in the nozzles. The breakage of the ink meniscuses may cause air to enter the nozzles and impair the functioning of the nozzles.

Therefore, there is a need for an inkjet head in which the pressure wave generated in one ink pressure chamber does not affect the ink in other ink pressure chambers (typically, adjacent) through the common ink chamber.

Japanese Patent Application Provisional Publication HEI 9-314832 also discloses an inkjet head provided with a plurality of ink pressure chambers and a common ink chamber connected thereto. The common ink chamber is formed to be U-shaped and is connected, at the middle thereof, to an ink supply channel. Ink from an external ink tank is supplied to the common ink chamber through the ink supply channel.

In the above mentioned inkjet head, pressure waves occur in the common ink chamber as the ink flows therein through the ink supply channel. The pressure waves transmit along the U-shaped common ink chamber toward the ends thereof. Then, the pressure waves are reflected at the ends of the common ink chamber and transmitted back along the common ink chamber to encounter pressure waves are subsequently generated and transmitted toward the ends of the common ink chamber. At locations of the reflected pressure waves and the subsequently generated pressure waves are encountered and superimposed on each other, such that a part of the pressure wave enters the ink pressure chambers, which increases/decreases the pressures of the ink pressure chambers, resulting in excessive/poor ink ejection from the corresponding nozzles.

It should be noted that the above mentioned inkjet head is further provided with a pair of narrow fluid channels extending from the ends of the common ink chamber. These fluid channels, however, are formed mainly to discharge air trapped in the common ink chamber and hence does not serve to effectively reduce the reflection of the pressure waves at the ends of the common ink chamber.

Japanese Patent Application Provisional Publication P2000-234170 discloses an inkjet head that includes a pair of common ink chambers for distributing ink among a plurality of ink pressure chambers. Each common ink chamber is formed in a relatively straight elongated shape and is connected to an ink supply channel at one end thereof so that ink from an external ink tank can be supplied thereto.

Japanese Patent Publication No. 2718010 also discloses an inkjet head that includes an elongated and substantially straight common ink chamber for distributing ink to a plurality of pressure chambers.

In the common ink chambers of the inkjet heads disclosed in the above mentioned two publications, the pressure waves are generated in the common ink channel, as ink is supplied thereto. The pressure waves transmit toward and are reflected back at the end of the common ink channel, and are superimposed on subsequently generated pressure waves which are similar to the pressure waves in the inkjet head disclosed in Japanese Patent Application Provisional Publication HEI 9-314832. Thus, the same problem, (i.e., insufficient/excessive ink supply) arises also in the inkjet jet heads disclosed in the above mentioned two publications.

Therefore, there is a need for an inkjet head that is provided with a common ink chamber capable of preventing significant reflection of pressure waves generated therein as ink is supplied thereto.

SUMMARY OF THE INVENTION

The present invention is advantageous in that an inkjet head is provided that satisfies the above mentioned needs.

An inkjet head according to an aspect of the invention includes a plurality of ink pressure chambers and a manifold channel. Each ink pressure chamber selectively pressurizes ink supplied thereto to eject the ink from the inkjet head. The manifold channel is in fluid communication with each of the ink pressure chambers and distributes ink thereamong. A land block, which is encircled with the ink, is formed in the manifold channel so that pressure waves transmitted into or generated in the manifold channel circulate around the land portion, thereby the pressure waves are attenuated and do not seriously affect the pressure in the ink pressure chambers.

An inkjet head according to another aspect of the invention includes a plurality of ink pressure chambers, each of which selectively pressurizes ink supplied thereto to eject the ink from the inkjet head. The inkjet head further includes a manifold channel that has a substantially looped shape and is in fluid communication with each of the ink pressure chambers to distribute the ink thereamong. In the manifold channel formed to be looped, pressure waves transmitted thereinto or generated therein, circulate along the manifold channel, so that the pressure waves are attenuated as they travel in the looped channel and do not seriously affect the pressure in the ink pressure chambers.

In another exemplary embodiment, the inkjet head may have a laminated structure of a plurality of plates including a manifold plate for defining the manifold channel. The manifold plate is provided with an opening formed therethrough with a portion thereof left in that opening so that the opening is formed in the substantially looped shape, or a land portion is formed in the opening.

In another exemplary embodiment, the portion left in the opening may be supported with a beam formed in the manifold plate. In this case, the beam may be formed thinner than the manifold plate so as not to prevent the pressure wave from transmitting around the land block or along the looped manifold channel.

It should be noted that the opening configured as above can be formed without difficulty by etching the manifold plate. It should also be noted that the thin beam can be formed by etching the manifold plate half-way of the thickness thereof (half-etching).

In an exemplary embodiment, the inkjet head includes a plurality of manifold plates stacked on each other to form the manifold channel. In such a case, the beams are formed in the manifold plates so as not to be completely overlapped when viewed in a direction in which the manifold plates are stacked. The beams arranged as above do not form a continuous wall that reflects back the pressure wave transmitting along the manifold channel.

In another exemplary embodiment, the inkjet head includes a first manifold plate formed with an opening for defining the manifold channel. A separate plate piece is placed in that opening to form the land portion or to form the manifold channel to form a loop. In this case, the separate plate piece is supported by two other plates sandwiching the first manifold plate.

Each of the two other plates, or second manifold plates, may be configured so as to have an opening formed therethrough with a portion thereof left in the opening, and being supported with a beam formed in the second manifold plate. In this case, the separate plate piece can be held between the portions of the second manifold plates left in the openings thereof.

In various exemplary embodiment, the openings of the first and second manifold plates are formed in substantially the same shape.

In various exemplary embodiment, the separate plate piece is formed in substantially the same shape as the portion of the second manifold plate left in the opening thereof.

In another exemplary embodiment, the inkjet head further includes a plurality of ink supply channels connected to the manifold channel to supply ink from the external ink supply to the manifold channel. In this case, it is ensured that ink can be supplied to the manifold channel even if one of the ink supply channels is clogged. Thus, stable ink ejection from the inkjet head is ensured in this case.

BRIEF DESCRIPTION OF THE DRAWINGS

Various exemplary embodiments of the apparatus according to the invention will be described in detail, with reference to the following figures, wherein.

DETAILED DESCRIPTION OF PREFERRED EMBODIMENTS

Hereinafter, an inkjet head according to an embodiment of the invention will be described with reference to the accompanying drawings.

Figure 1:
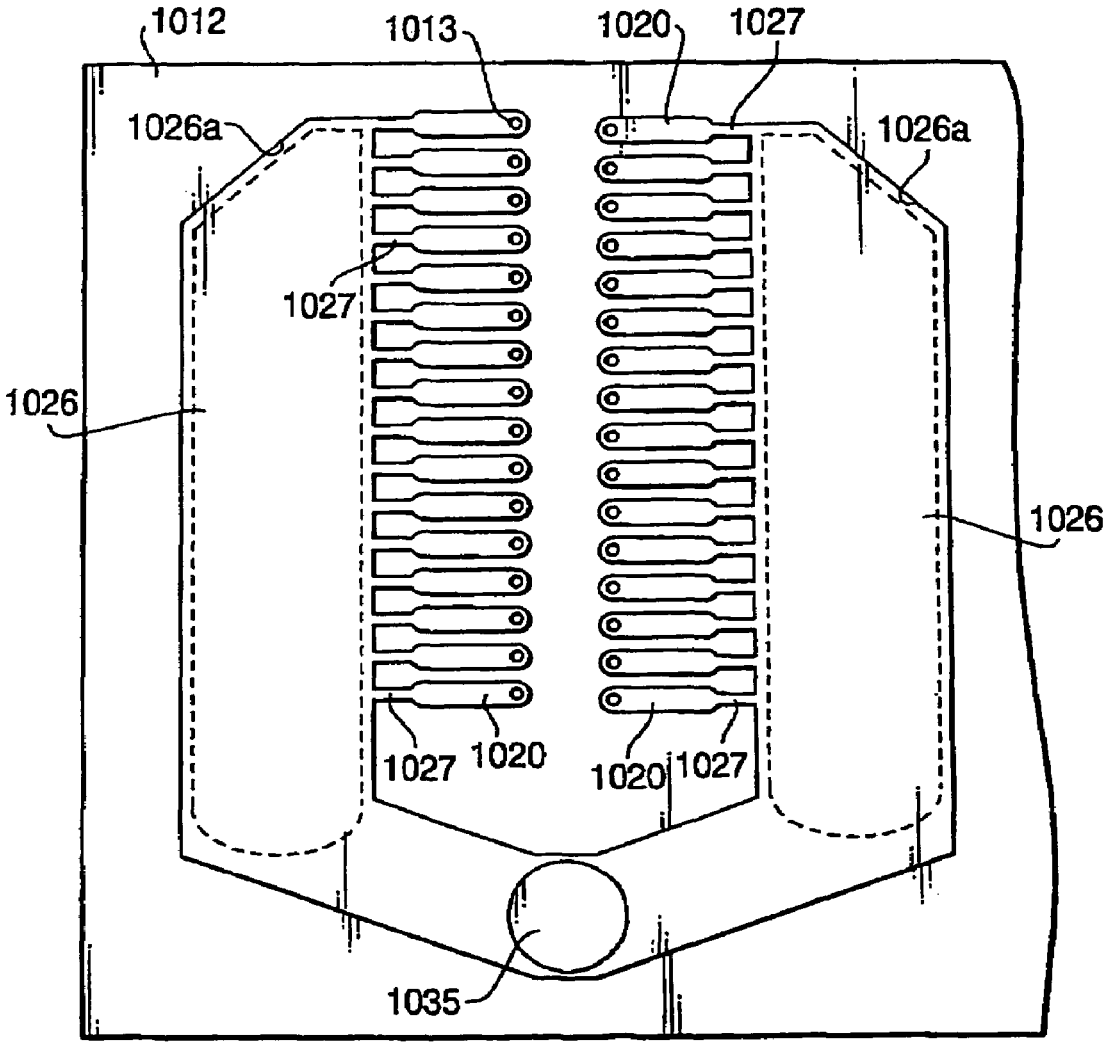
FIG. 1 PRIOR ART
FIG. 1 schematically shows an ink flow channel formed in an inkjet head according to a prior art.
Figure 2:
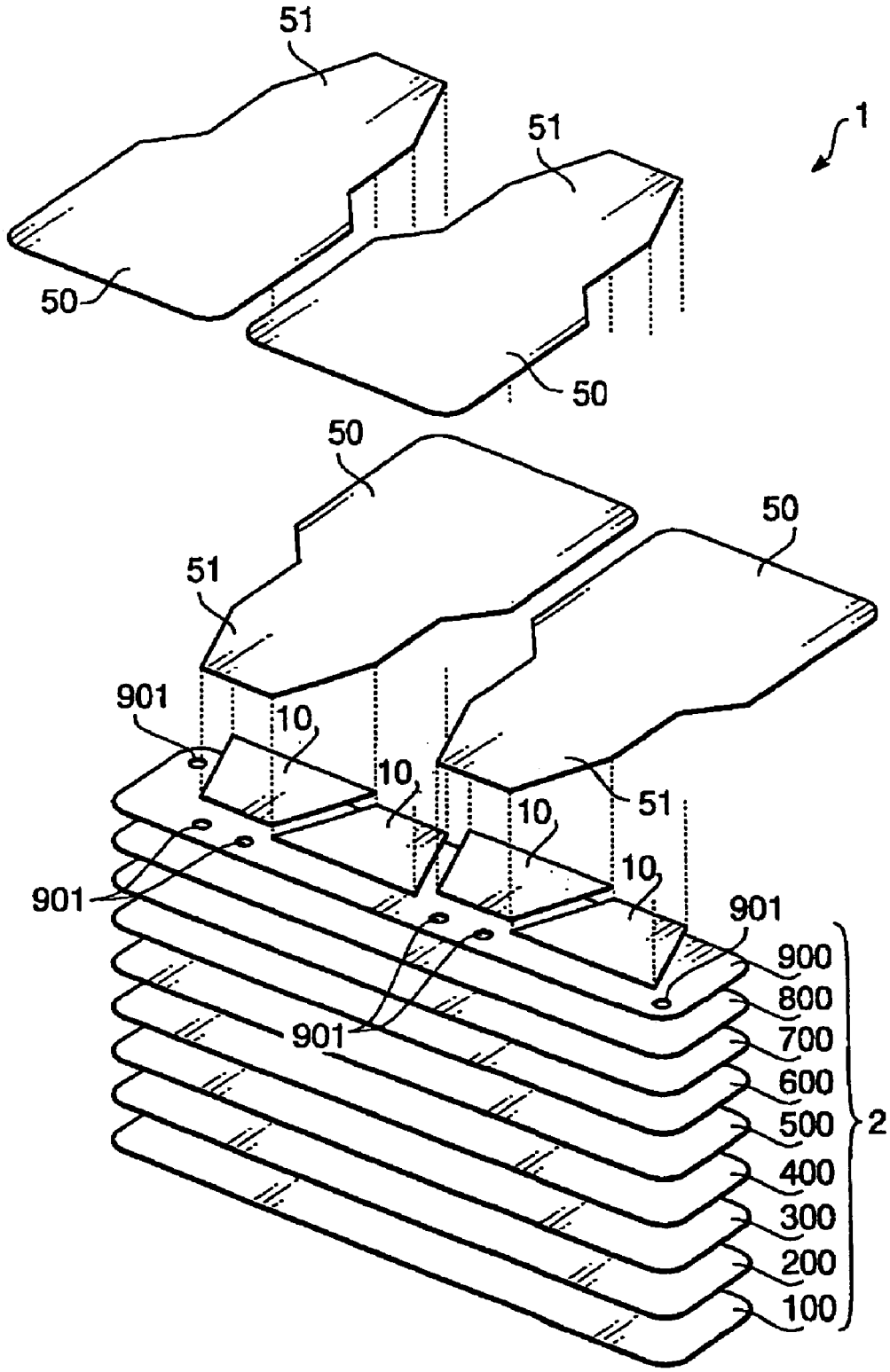
FIG. 2 is an exploded perspective view of an inkjet head according to an embodiment of the invention.

FIG. 2 is an exploded perspective view of the inkjet head 1 according to the embodiment of the invention. The inkjet head 1 includes a body 2 and four trapezoidal plate type piezoelectric sheets 10 bonded on the top face of the body 2 by adhesive. The inkjet head 1 further includes four flexible printed circuit boards 50, which will be referred to hereinafter as FPC boards 50. Each FCP board 50 has an extended portion 51, which is bonded on the top face of the corresponding piezoelectric sheet 10 by adhesive so as to be electrically connected with the piezoelectric sheet 10. Further, each FCP board 50 is provided with a driving integral circuit (driving IC) thereon (not shown).

Figure 3:
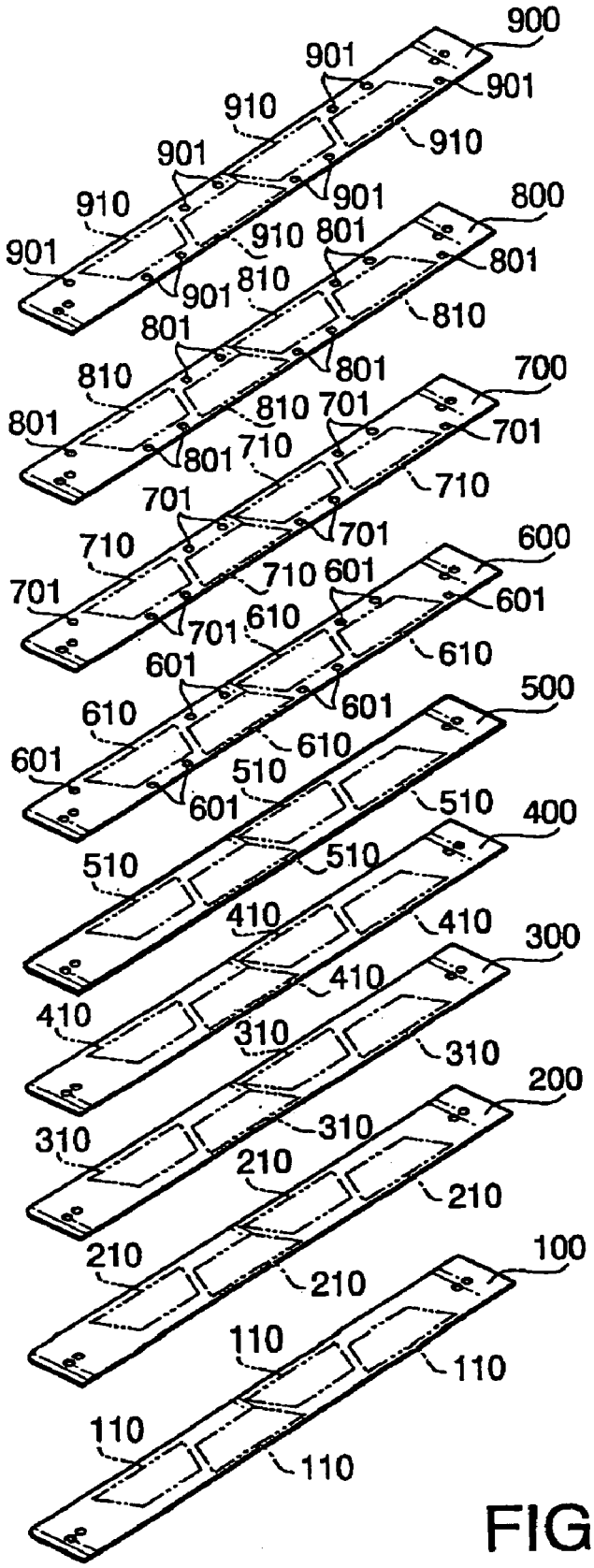
FIG. 3 schematically shows an exploded perspective view of a body of the inkjet head shown in FIG. 2.

FIG. 3 schematically shows an exploded perspective view of the body 2 of the inkjet head 1 shown in FIG. 2. The body 2 has a laminated structure composed of a plurality of substantially rectangular thin metal sheets. In an exemplary embodiment, the body 2 is composed of nine metal sheets, which are a nozzle plate 100, a cover plate 200, a first plate 300, a second manifold plate 400, a third manifold plate 500, a supply plate 600, an aperture plate 700, a base plate 800, and a cavity plate 900 from the bottom of the body 2. On each of the nine plates, four printing areas (110, 210, 310, 410, 510, 610, 710, 810, 910) are defined at locations below respective piezoelectric sheets 10. Each printing area has the same trapezoidal form as the piezoelectric sheet 10.

Figure 4:
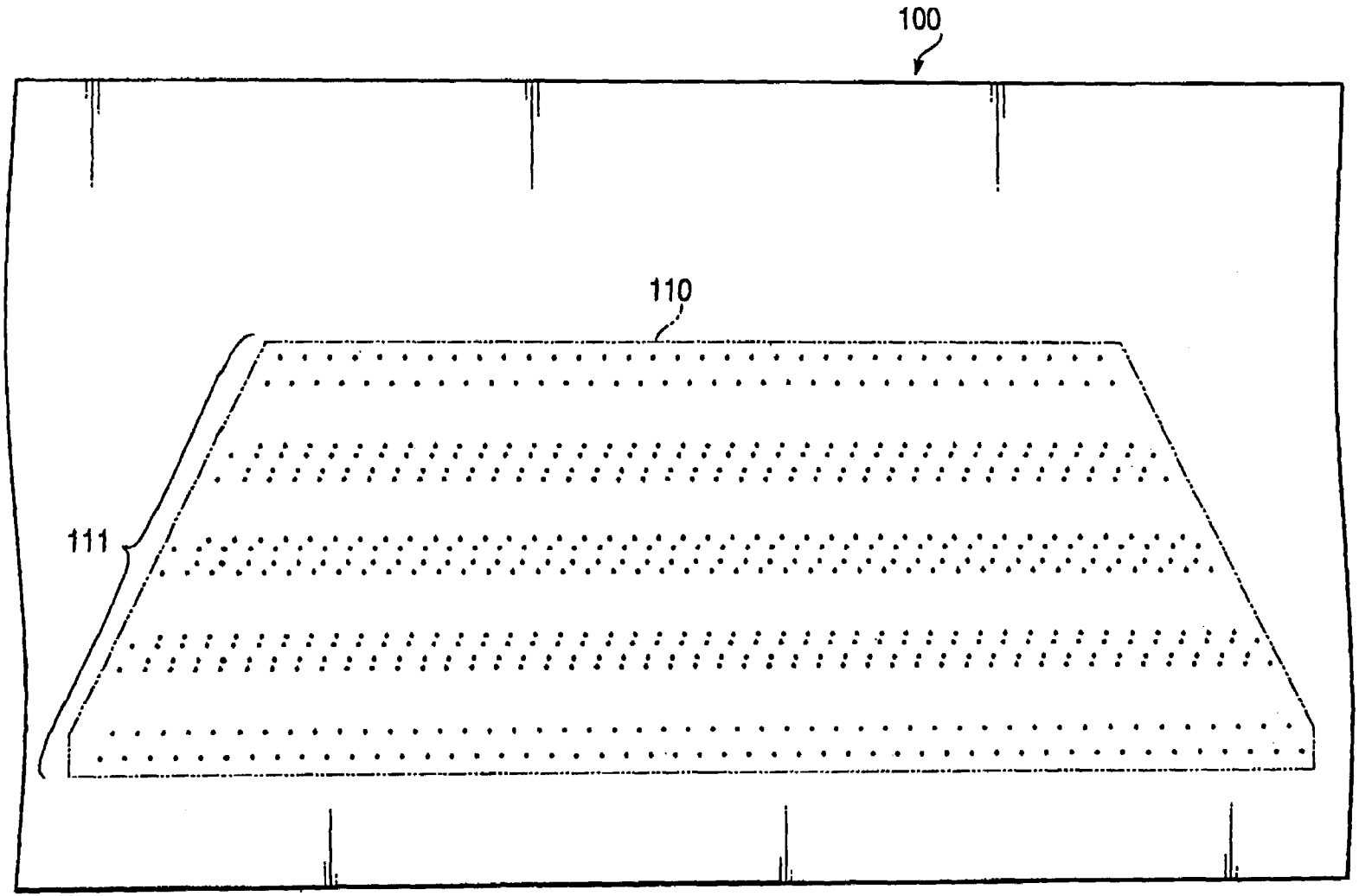
FIG. 4 is a plane view of a part of a nozzle plate of the inkjet head shown in FIG. 2.

FIG. 4 is a plane view of a part of the nozzle plate 100. As shown in FIG. 4, each printing area 110 on the nozzle plate 100 is provided with a plurality of fine diameter nozzles 111 for ejecting ink formed through the nozzle plate 100. The number and arrangement of the nozzles 111 are determined in accordance with a printing resolution required for the inkjet head 1. In an exemplary embodiment, the required printing resolution is about 600 dpi, for example. Note that the nozzles 111 are formed by means of etching. Thus, the nozzle plate 100 can be produced easily and at a low cost.

Figure 5A:
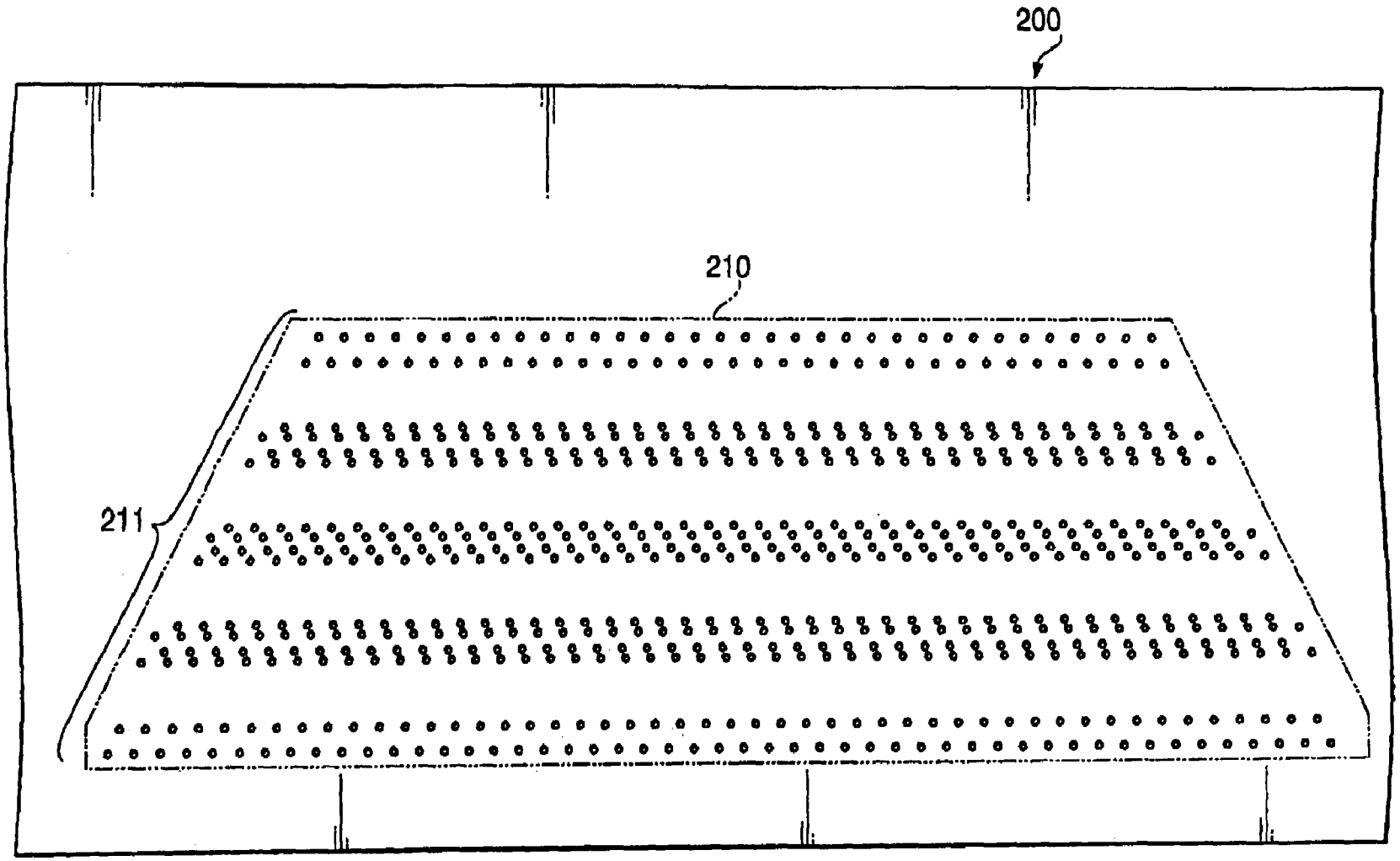
FIG. 5A is a plane view of a part of a cover plate of the inkjet head shown in FIG. 2.

FIG. 5A is a plane view of a part of the cover plate 200. As shown in FIG. 5A, each printing area 210 on the cover plate 200 is provided with a plurality of fine diameter through holes 211, which serve as ink channels. The through holes 211 are formed at positions corresponding to the nozzles 111 of the nozzle plate 100, respectively. Thus, when the cover plate 200 is laid on top of the nozzle plate 100, fluid communication is established between each through hole 211 and the corresponding nozzle 111 (see FIG. 28).

Figure 5B:
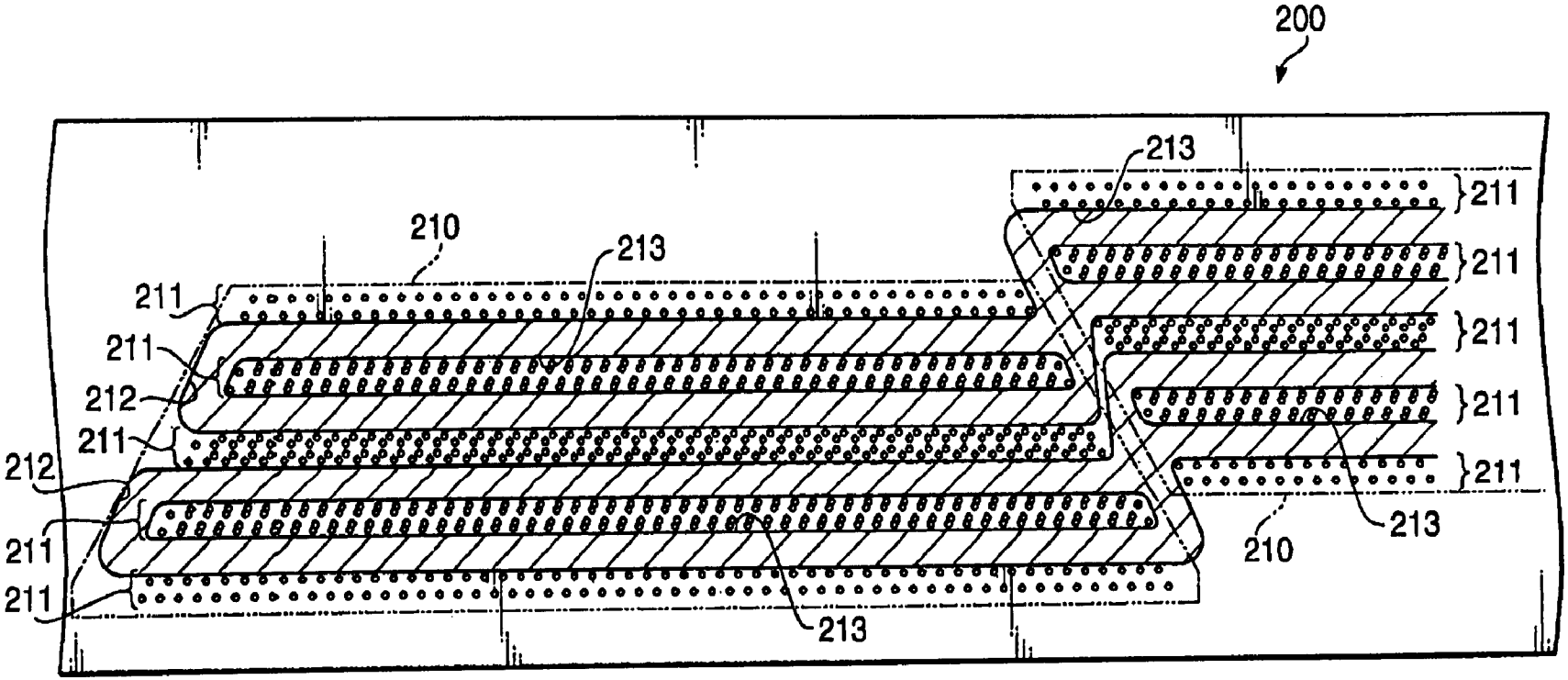
FIG. 5B shows a part of an under surface of the cover plate shown in FIG. 5A.

FIG. 5B shows a part of the under surface of the cover plate 200. The under surface of the cover plate 200 is provided with two elongated grooves 212. The grooves 212 are formed so as to pass through each printing area 210 and so as to extend substantially straight along the longitudinal direction of the cover plate 200 within each printing area 210. Within each printing area 210, each groove 212 is provided with a land portion 213 which is flush with the under surface of the cover plate 200. Each land portion 213 is formed elongated in the longitudinal direction of the cover plate 200. The through holes 211 are formed outside the grooves 212, along the outer peripheries thereof and also within each land portion 213. Note that the through holes 211 and the grooves 212 are formed by means of etching. Thus, the cover plate 200 can be produced easily and at a low cost.

Figure 6:
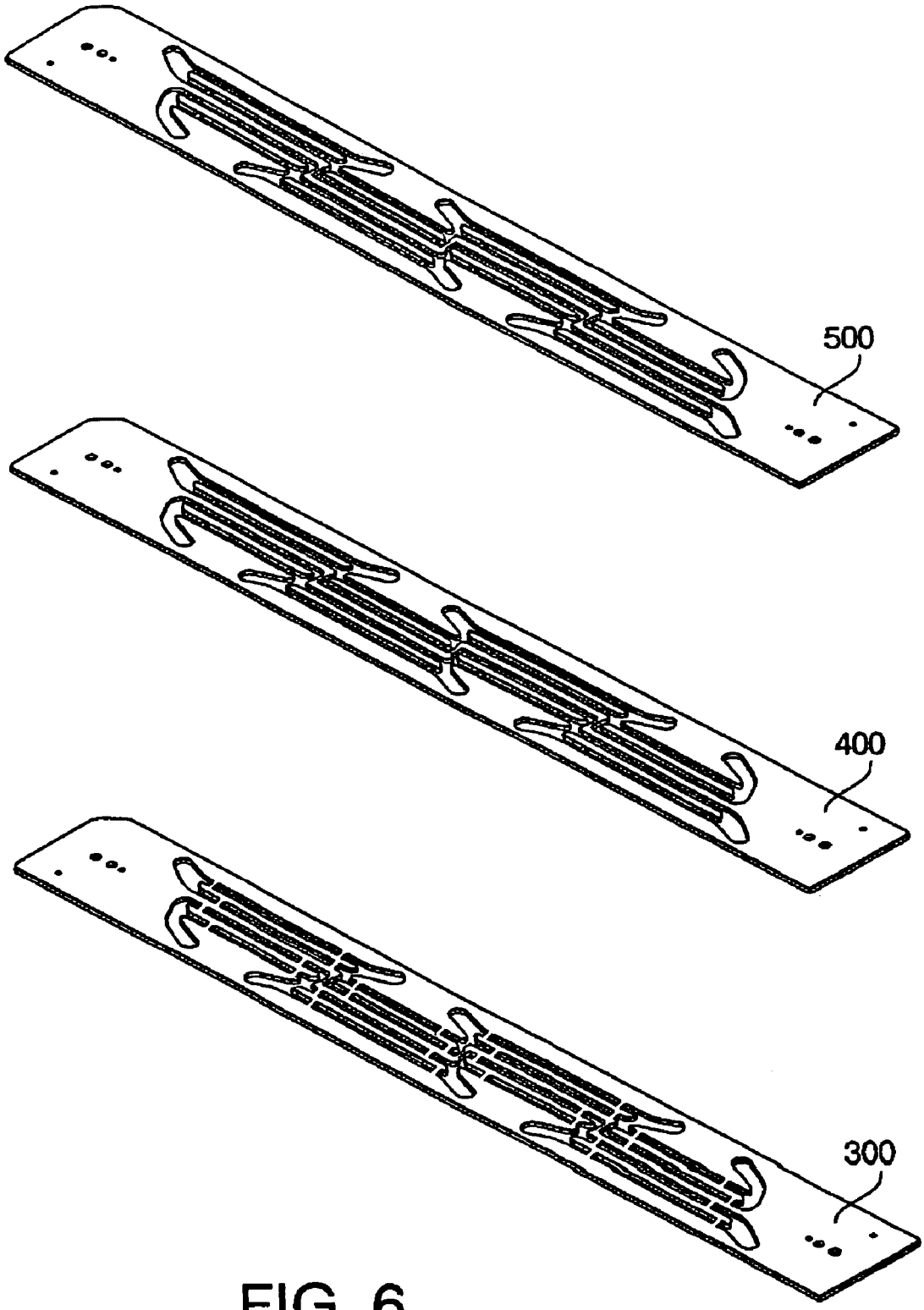
FIG. 6 shows perspective views of the first, second and third manifold plates of the inkjet head shown in FIG. 2.
Figure 7:
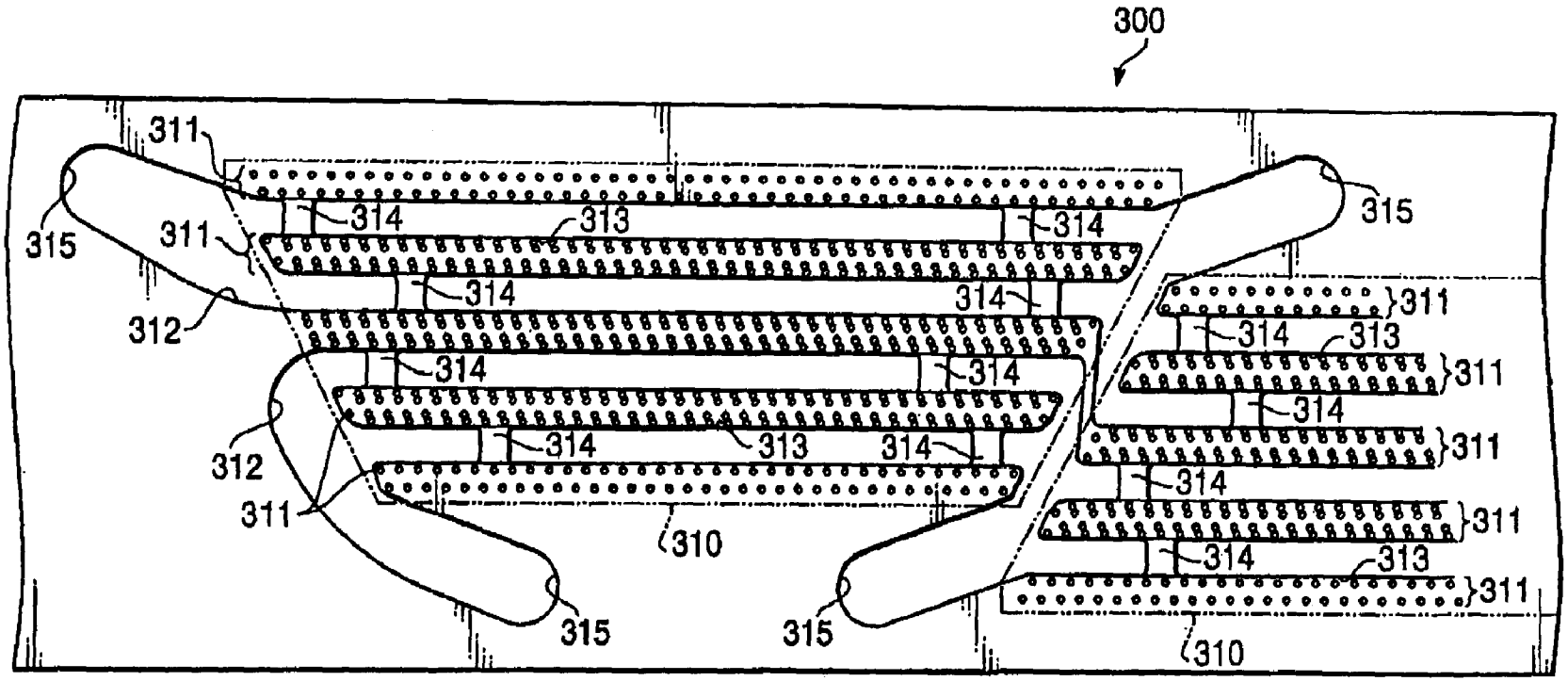
FIGS. 7, 8 and 9 are plane views of parts of first, second and third manifold plates of the inkjet head shown in FIG. 2.

FIG. 6 shows a perspective exploded view of the first, second and third manifold plates 300, 400 and 500. FIG. 7 shows a plane view of a part of the first manifold plate 300. The first manifold plate 300 is formed with a plurality of through holes 311, which serve as ink channels. The through holes 311 of the first manifold plate 300 are formed at positions corresponding to the through holes 211 of the cover plate 200, respectively. Thus, the through holes 311 of the first manifold plate 300 establish fluid communication with the through holes 211 of the cover plate 200 when the first manifold plate 300 is laid on top of the cover plated 200 (see FIG. 28).

Further, the first manifold plate 300 is provided with two elongated openings 312 formed therethrough by etching. The openings 312 are formed so as to pass through each printing area 310 such that the portions thereof within each printing area 310 extend substantially straight along the longitudinal direction of the first manifold plate 300. The openings 312 constitute a part of a pair of manifold channels 20 which will be describe latter (see FIG. 28).

Within each printing area 310, each opening 312 is provided with an elongated land portion 313 that extends in the longitudinal direction of the first manifold plate 300. Each land portion 313 has a top surface and an under surface that are flush with the top surface and the under surface of the first manifold plate 300, respectively. Each land portion 313 is supported by a plurality of connection beams 314, which are formed by half-etching, or etching the manifold plate 300 half-way of the thickness, from the underside thereof. Thus, the thickness of each connection beam 34 is less than that of the first manifold plate 300. In an exemplary embodiment, the thickness of the connection beam 34 is about one half of that of the first manifold plate 300.

Note that the through holes 311 are formed in the first manifold plate 30 along the outer peripheries of the openings 312 and on the land portions 313. It should be also noted that a plurality of ink supply portions (openings) 315 extends from each of the openings 312.

Figure 8:
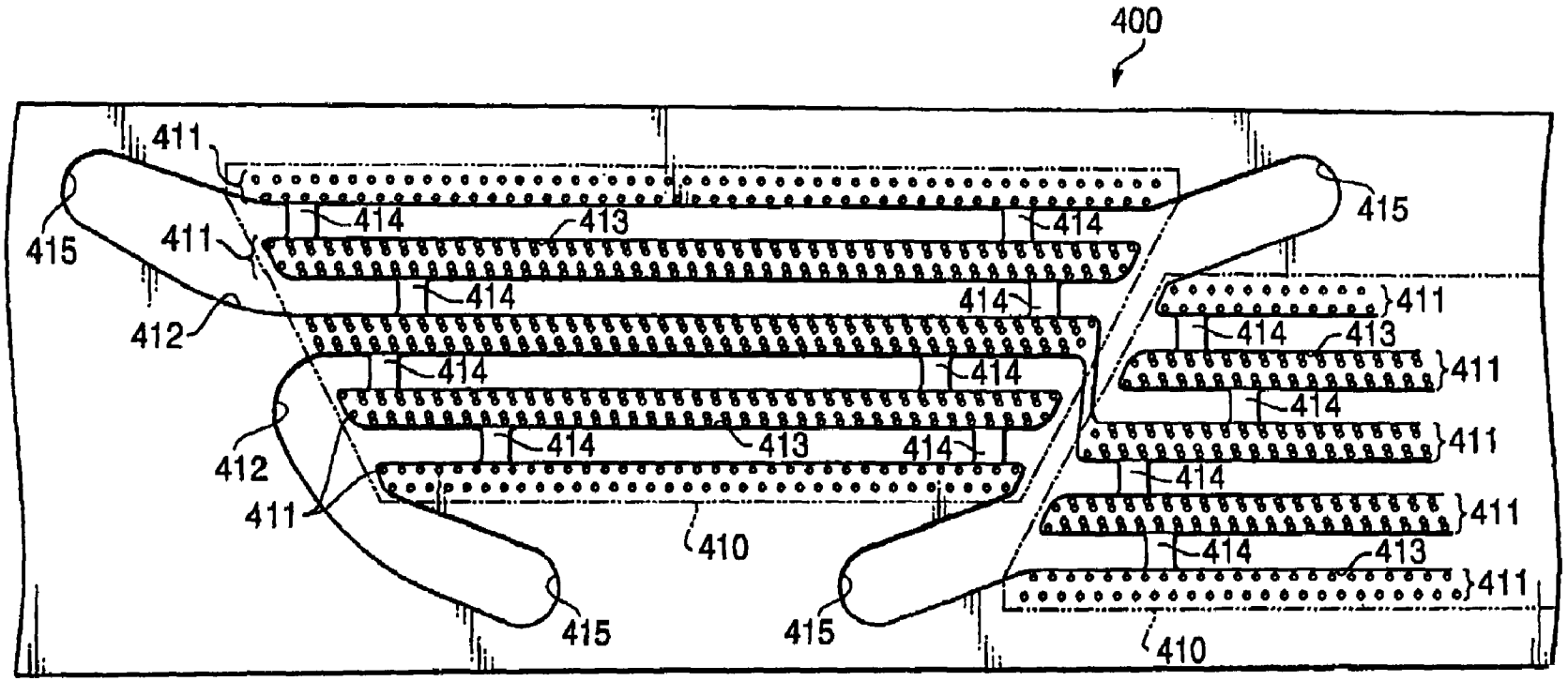

FIG. 8 is a plane view of a part of the second manifold plate 400. The second manifold plate 400 is formed with a plurality of through holes 411, which serve as ink channels. The through holes 411 of the second manifold plate 400 are formed at positions corresponding to the through holes 311 of the first manifold plate 300, respectively. Thus, the through holes 411 of the second manifold plate 400 establish fluid communication with the through holes 311 of the first manifold plate 300 when the second manifold plate 400 is laid on top of the first manifold plate 300 (see FIG. 28).

Further, the second manifold plate 400 is provided with two elongated openings 412 formed therethrough by etching. The two openings 412 have substantially the same form as the openings 312 of the first manifold plate 300. That is, the openings 412 are formed so as to pass through each printing area 410 such that the portions thereof within each printing are 410 extend substantially straight along the longitudinal direction of the second manifold plate 400. The openings 412 of the second manifold plate 400 are formed at positions corresponding to the respective openings 312 of the first manifold plate 300. Thus, the openings 412 of the second manifold plate 400 establish fluid communication with the openings 312 of the first manifold plate 300 when the second manifold plate 400 is laid on top of the first manifold plate 300 and thereby constitute a part of the manifold channels 20 together with the openings 312 (see FIG. 28).

Within each printing area 410, each opening 412 is provided with an elongated land portion 413 that extends in the longitudinal direction of the second manifold plate 400. Each land portion 413 has a top surface and an under surface that are flush with the top surface and under surface of the second manifold plate 400, respectively. The land portions 413 are supported by a plurality of connection beams 414, which are formed by half-etching from the upper side of the second manifold plate 400. The thickness of each connection beam 414 is about one half of that of the second manifold plate 400.

Note that the through holes 411 are formed outside the openings 412 along the outer peripheries thereof and within the land portions 413.

It should be also noted that a plurality of ink supply portions (openings) 415 are formed in the second manifold plate 400 so as to extend from the openings 412 at positions corresponding to the ink supply portions 315 of the first manifold plate 300. Thus, when the second manifold plate 400 is laid on top of the first manifold plate 300, the ink supply portions 415 of the second manifold plate 400 are brought into fluid communication with the ink supply portions 315 of the first manifold plate 300.

Figure 9:
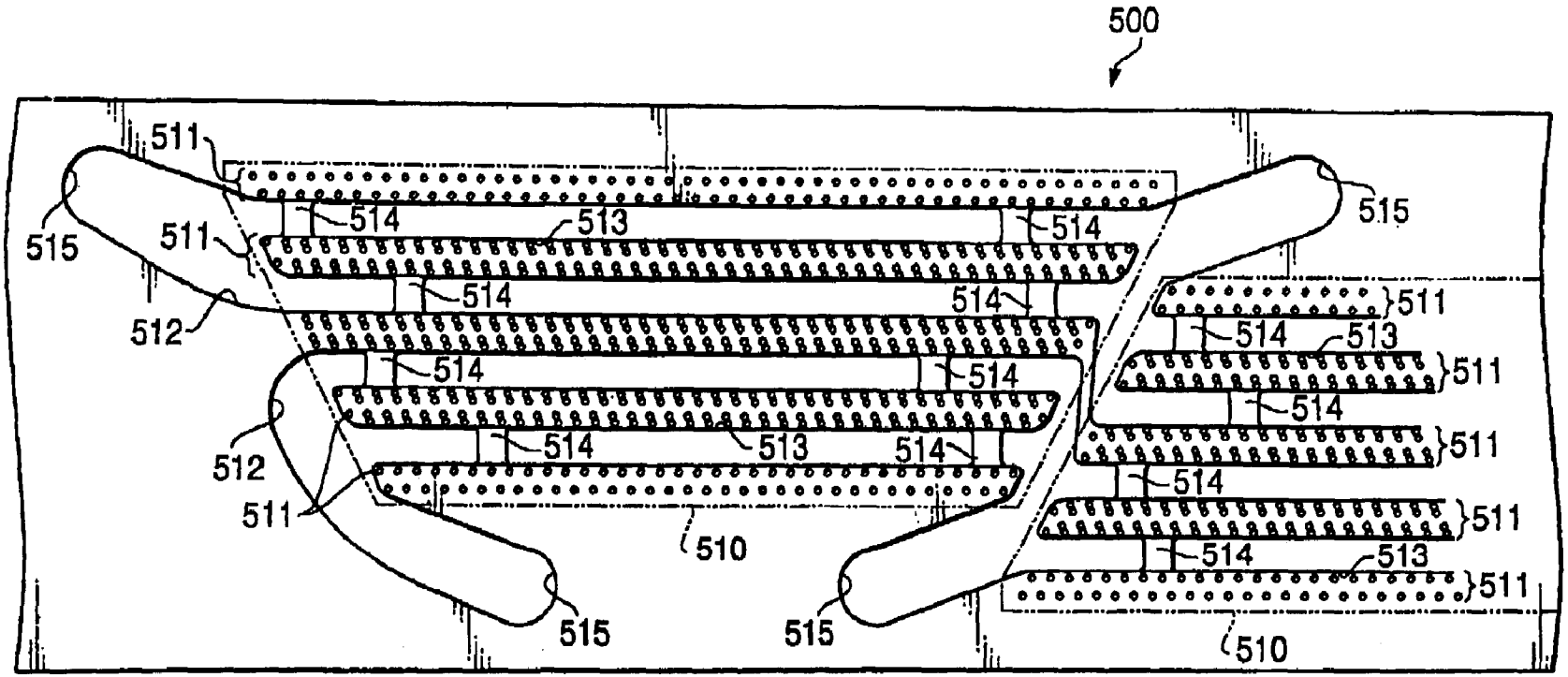

FIG. 9 is a plane view of a part of the third manifold plate 500. The third manifold plate 500 is formed with a plurality of through holes 511, which serve as ink channels. The through holes 511 of the third manifold plate 500 are formed at positions corresponding to the through holes 411 of the second manifold plate 400, respectively. Thus, the through holes 511 of the third manifold plate 500 are brought into fluid communication with the through holes 411 of the second manifold plate 400 when the third manifold plate 500 is laid on top of the second manifold plate 400 (see FIG. 28).

Further, the third manifold plate 500 is provided with two elongated openings 512 formed therethrough by etching. The two openings 512 have substantially the same form as the openings 412 of the second manifold plate 400. That is, the openings are formed so as to pass through each printing area 510 such that the portions thereof within each printing area 510 extend substantially straight along the longitudinal direction of the third manifold plate 500. The openings 512 of the third manifold plate 500 are formed at positions corresponding to the respective openings 412 of the second manifold plate 400. Thus, the openings 512 of the third manifold plate 500 establish fluid communication with the openings 412 of the second manifold plate 400 when the third manifold plate 500 is laid on top of the second manifold plate 400 and thereby constitute a part of the manifold channels 20 together with the openings 312 and 412 (see FIG. 28).

Each opening 512 includes a plurality of elongated land portions 513. Each land portion 513 has a top surface and an under surface that are flush with the top surface and under surface of the third manifold plate 500. The land portions 513 are supported by a plurality of connection beams 514, which are formed by half-etching from the upper side of the third manifold plate 500. The thickness of each connection beam 514 is about one half of that of the third manifold plate 500.

Note that the through holes 511 are formed along the outer peripheries of the openings 512 and on the land portions 513.

It should be also noted that a plurality of ink supply portions (openings) 515 are formed in the third manifold plate 500 so as to extend from the openings 512 at positions corresponding to the ink supply portions 415 of the second manifold plate 400, respectively. Thus, when the third manifold plate 500 is laid on top of the second manifold plate 400, the ink supply portions 515 of the third manifold plate 500 is brought into fluid communication with the ink supply portions 415 of the second manifold plate 400. As will be described later, the manifold channels 20 composed of the openings 312, 412, and 512 are supplied with ink through the ink supply portions 515. The ink supply portions 515 are formed in a vicinity of each end of the elongated portion of the openings 512 defined within each printing area 510. Thus, ink can be effectively supplied into each manifold channel 20 although it has an elongated shape within each printing areas 510.

Figure 10:
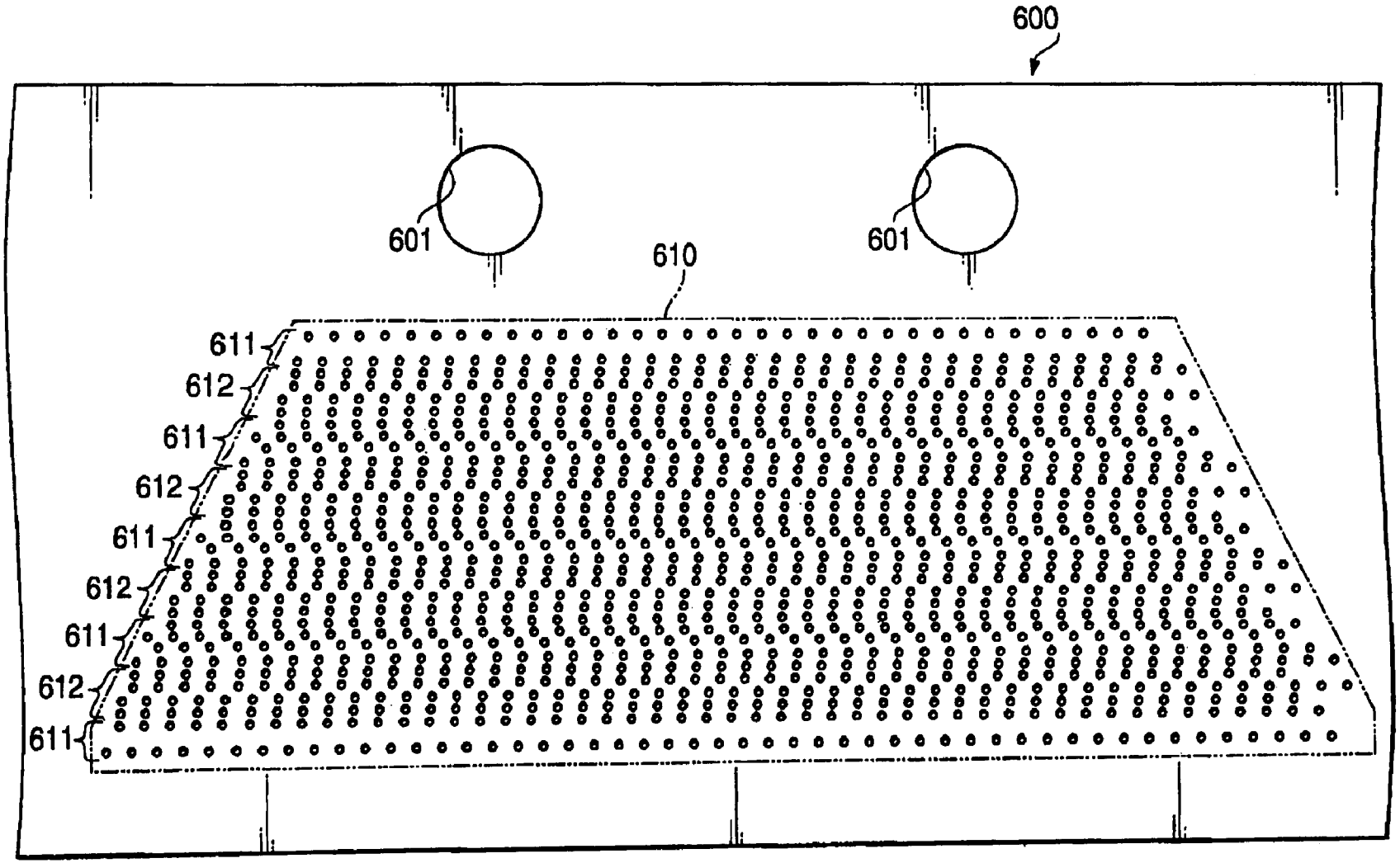
FIG. 10 is a plane view of a part of a supply plate of the inkjet head shown in FIG. 2.

FIG. 10 is a plane view of a part of the supply plate 600. As shown in FIG. 10, each printing area 610 on the supply plate 600 is provided with a plurality of fine diameter through holes 611, which serve as ink channels, and a plurality of filter portions 612, which also serve as ink channels.

The through holes 611 are formed at positions corresponding to the through holes 511 of the third manifold plate 500. Thus, the through holes 611 of the supply plate 600 establish fluid communication with the through holes 511 of the third manifold plate 500 when the supply plate 600 is laid on top of the third manifold plate 500 (see FIG. 28).

Figure 28:
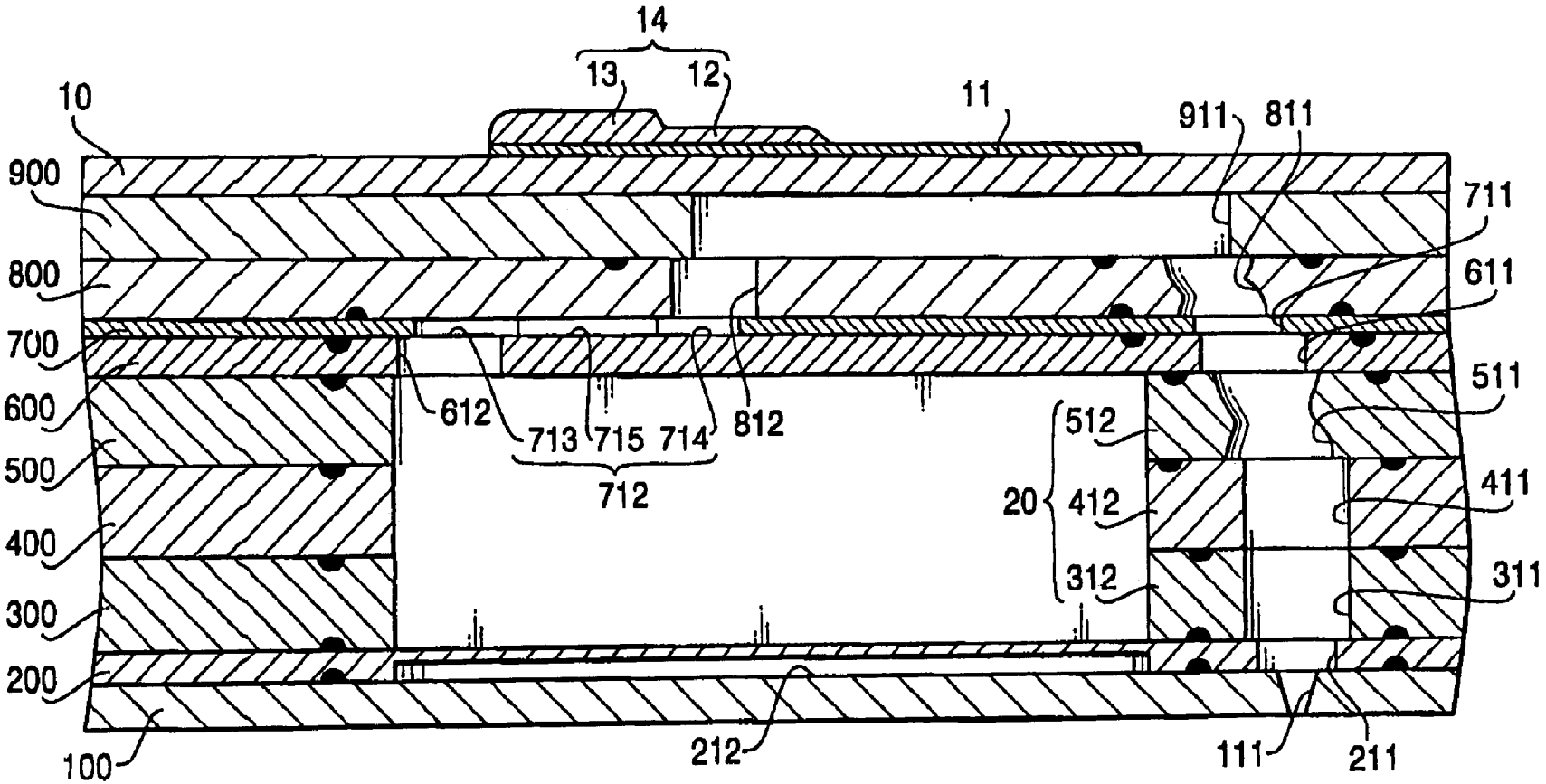
FIG. 28 is a sectional view of a part of the inkjet head showing a part of an ink channel extending from one of the nozzles.

Each filter portion 612 of the supply plate 600 is formed so as to establish fluid communication with either of the two openings 512 when the supply plate 600 is laid on top of the third manifold plate 500 (see FIG. 28).

Figure 11:
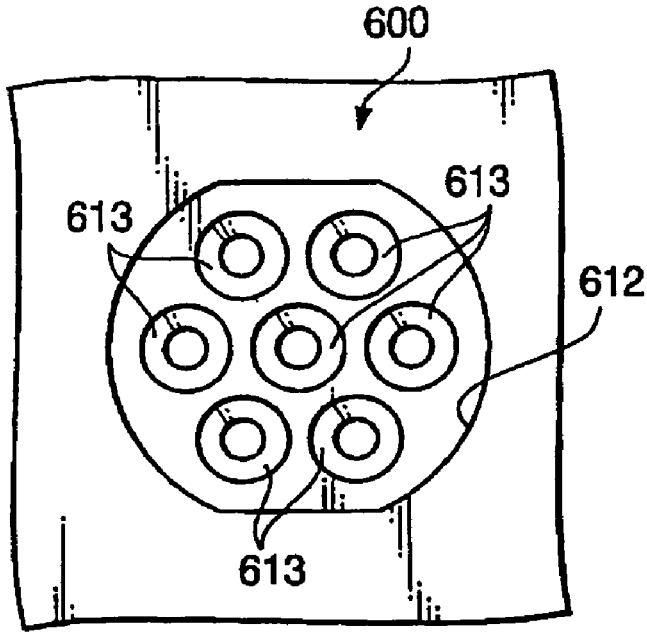
FIG. 11 shows a top view of a filter portion of the supply plate shown in FIG. 10.
Figure 12:
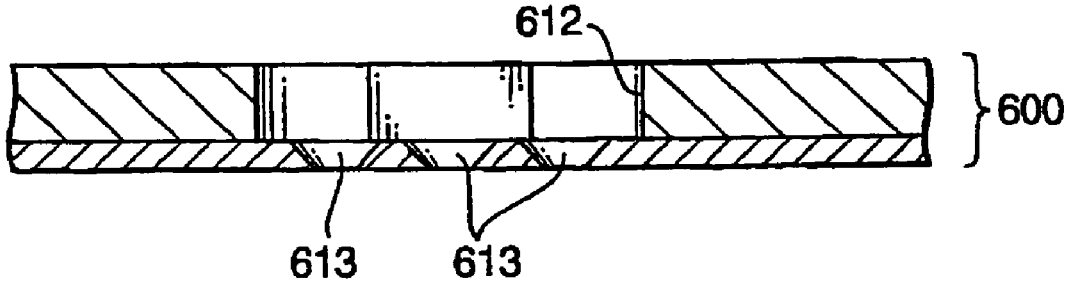
FIG. 12 shows a sectional view of the supply plate at a part thereof including the filter portion shown in FIG. 11.

FIG. 11 shows an enlarged top view of the filter portion 612 of the supply plate 600, and FIG. 12 shows a sectional view of the supply plate 600 at a part thereof including one of the filter portion 612. As shown in FIGS. 11 and 12, the filter portions 612 is a recess formed on the supply plate 600, which the recess is provided with a plurality of filter holes 613 formed through the bottom thereof. The filter holes 613 remove foreign particles from the ink passing through the filter portion 612.

Referring back to FIGS. 3 and 10, the supply plate 600 is further provided with ten small size ink supply openings 601 formed through the supply plate 600 at positions outside the substantially trapezoidal printing areas 610. The ink supply openings 601 are formed so as to face and thereby establish fluid communication with respective ones of the ink supply portions 515 of the third manifold plate 500 when the supply plate 600 is laid on top of the third manifold plate 500.

Figure 13:
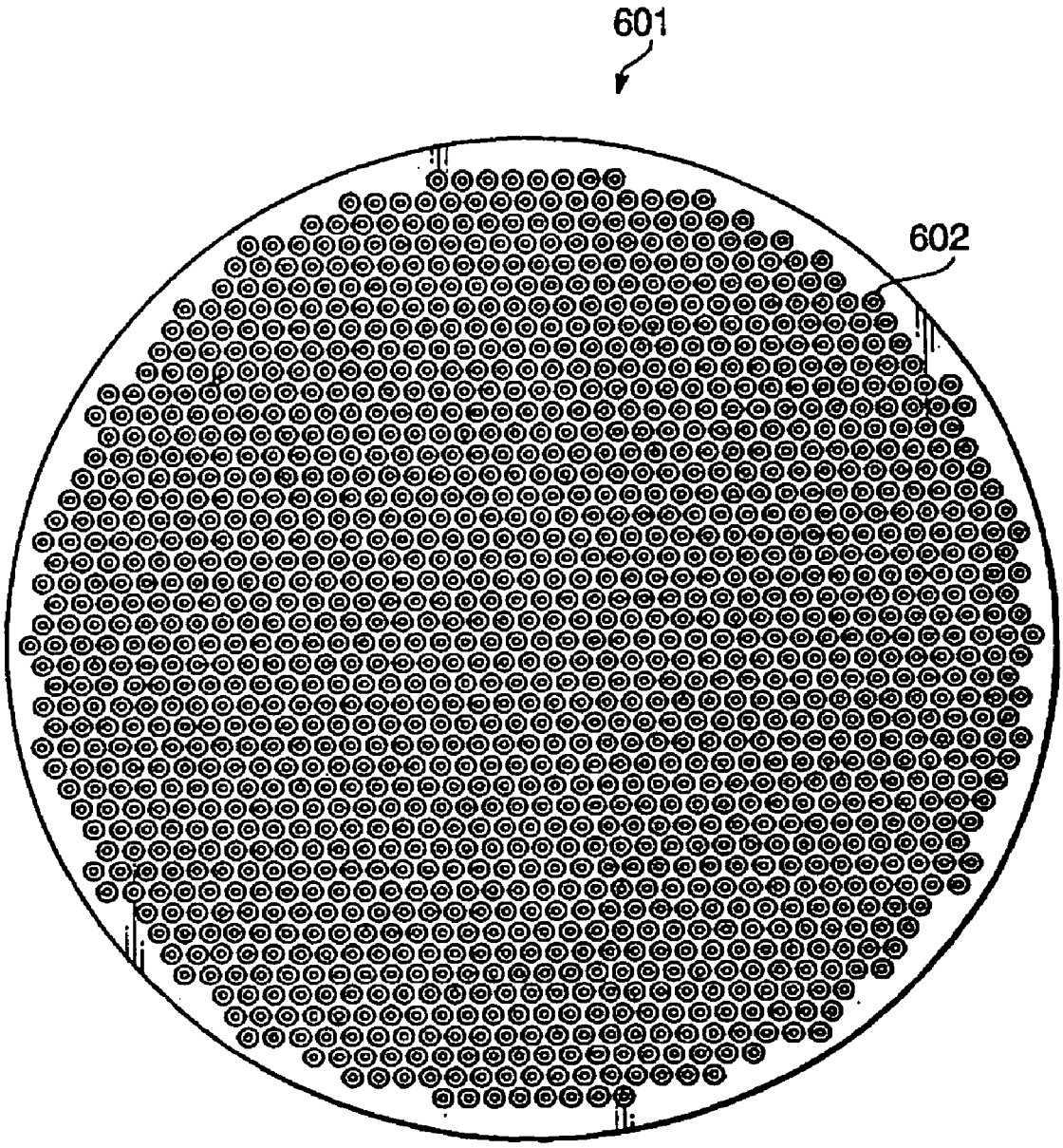
FIG. 13 is a top view of an ink supply opening of the supply plate shown in FIG. 12.

FIG. 13 is an enlarged top view of the ink supply opening 601. As shown in FIG. 13, the ink supply opening 601 is formed with a plurality of filter holes 602 that prevent foreign particles (e.g., dust) within the ink from being introduced into the manifold channels 20.

Figure 14:
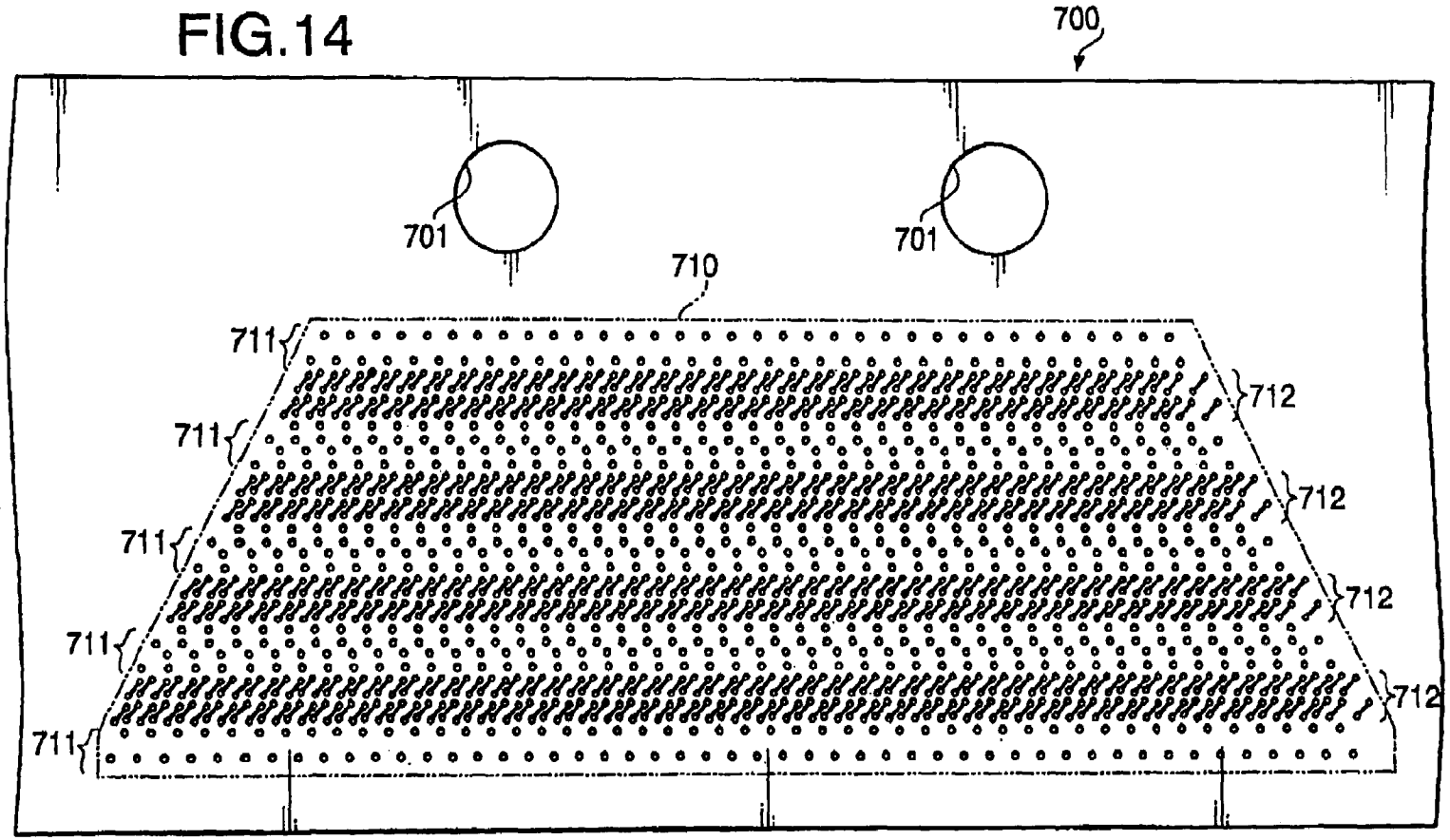
FIG. 14 shows a top view of a part of an aperture plate of the inkjet head shown in FIG. 2.

FIG. 14 is a plane view of a part of the aperture plate 700. As shown in FIG. 14, each printing area 710 on the aperture plate 700 is provided with a plurality of fine diameter through holes 711 and a plurality of restriction portions 712. The through holes 711 are formed so as to face and thereby establish fluid communication with the respective through holes 611 of the supply plate 600 when the aperture plate 700 is laid on top of the supply plate 600 (see FIG. 28).

Figure 15:
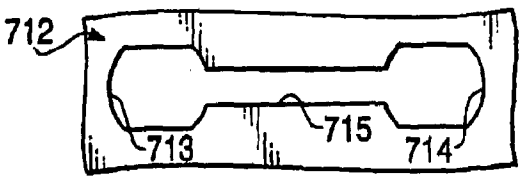
FIG. 15 is a top view of a restriction portion of the aperture plate shown in FIG. 14.

FIG. 15 is an enlarged top view of the restriction portion 712. The restriction portion 712 is a through hole formed in the aperture plate 700 by press work. The restriction portion 712 has an inlet portion 713, an outlet portion 714, and a channel portion 715 extending between the inlet portion 713 and outlet portion 714 to bring them in fluid communication with each other.

The restriction portions 712 are located so that the inlet portion 713 generally face and thereby establish fluid communication with respective filter portions 612 of the supply plate 600 as the aperture plate 700 is laid on the top of the supply plate 600 (see FIG. 28).

Referring back to FIGS. 3 and 14, the aperture plate 700 is further provided with ten small size ink supply openings 701 formed therethrough at positions outside the four printing areas 710. The ink supply openings 701 are formed so as to face and thereby establish fluid communication with respective ink supply openings 601 of the supply plate 600 as the aperture plate 700 is laid on top of the supply plate 600.

Figure 16:
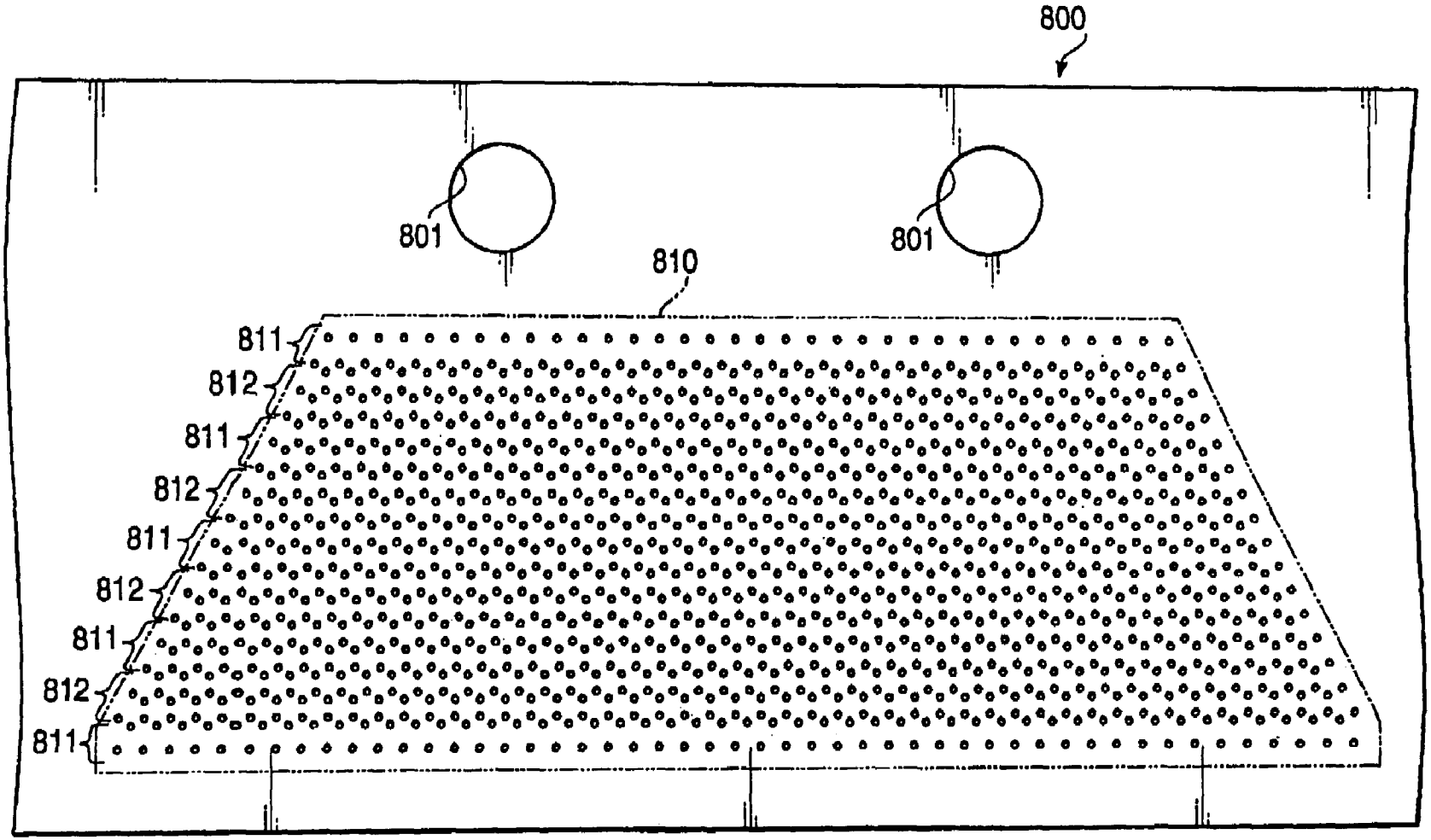
FIG. 16 shows a top view of a part of a base plate of the inkjet head shown in FIG. 2.

FIG. 16 is a plane view of a part of the base plate 800. As shown in FIG. 16, each printing area 810 on the base plate 800 is provided with a plurality of fine diameter through holes 811 and a plurality of fine diameter through holes 812, both of which serve as ink channels. The through holes 811 are formed so as to face and thereby establish fluid communication with the through holes 711 of the aperture plate 700 when the base plate 800 is laid on top of the aperture plate 700 (see FIG. 28). The through holes 812 are formed so as to generally face and thereby establish fluid communication with the restriction portions 712 of the aperture plate 700 when the base plate 800 is laid on top of the aperture plate 700 (see FIG. 28).

The base plate 800 is further provided with ten small size ink supply opening 801 formed therethrough at positions outside the four printing areas 810. The ink supply openings 801 are formed so as to face and thereby establish fluid communication with the ink supply openings 701 of the aperture plate 700 as the base plate 800 is laid on top of the aperture plate 700.

Figure 17:
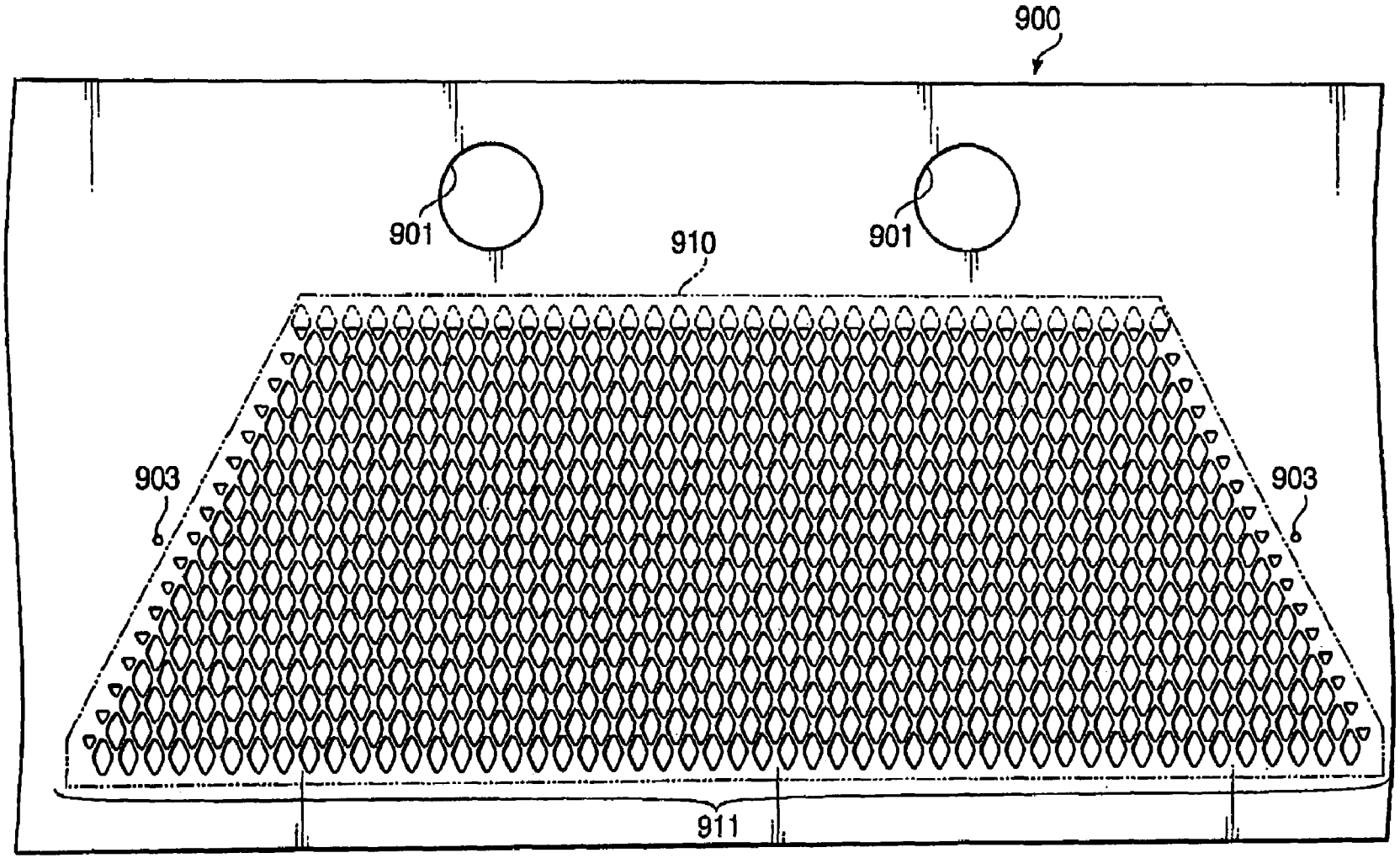
FIG. 17 shows a top view of a part of a cavity plate of the inkjet head shown in FIG. 2.

FIG. 17 is a plane view of a part of the cavity plate 900. As shown in FIG. 17, each printing area 910 on the cavity plate 900 is provided with a plurality of substantially rhombus openings, or ink pressure chambers 911, that are formed through the cavity plate 900. The ink pressure chambers 911 are arranged in matrix and at density corresponding to the printing resolution required for the inkjet head 1.

Each ink pressure chamber 911 has a pair of acute angle corners and a pair of obtuse angle corners. The ink pressure chambers 911 are arranged such that the acute angle corners of each ink pressure chamber 911 are placed between acute angle corners of adjacent ink pressure chambers 911, so that the ink pressure chambers can be arranged at high density.

The ink pressure chambers 911 are also arranged such that one of the acute angle corners of each ink pressure chamber 911 faces and establishes fluid communication with one of the through holes 811 of the base plate 800, while the other one of the acute angle corners faces and establishes fluid communication with one of the through holes 812 of the base plate 800, when the cavity plate 900 is laid on top of the base plate 800 (see FIG. 28).

The cavity plate 900 is also provided with ten small size ink supply openings 901 which are formed at positions outside the printing areas 910. The ink supply openings 901 are formed so as to face and establish fluid communication with respective ink supply openings 801 of the base plate 800 as the cavity plate 900 is laid on top of the base plate 800.

It should be also noted that positioning holes 903 are formed in a vicinity of each oblique side of each printing area 910. These positioning holes assist in positioning of the piezoelectric sheets 10 on the cavity plate 900.

Next, general structures of the piezoelectric sheet 10 and the FPC board 50 as well as the electrical connection therebetween will be described.

Figure 18:
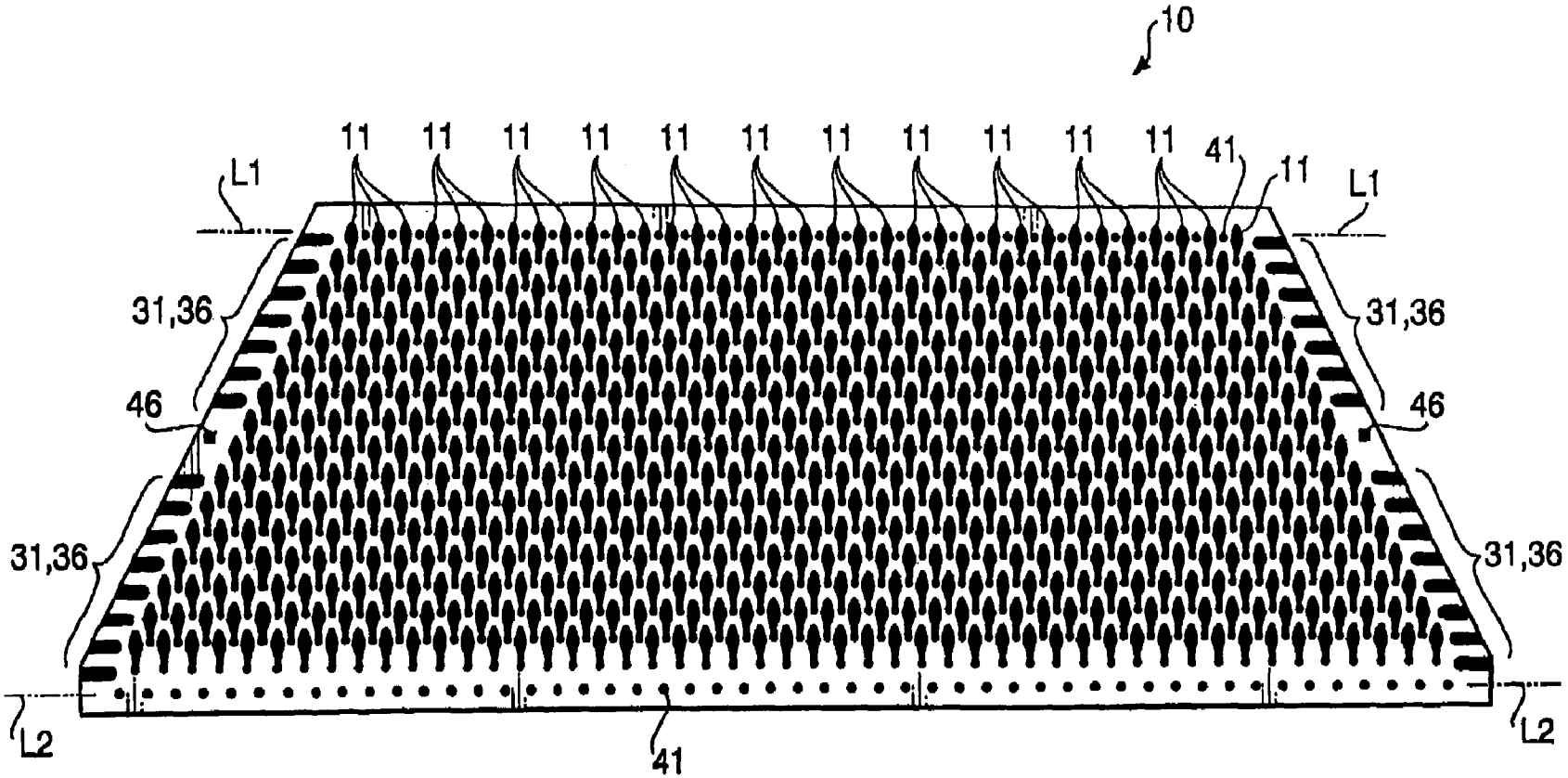
FIG. 18 shows a top view of a piezoelectric sheet of the inkjet head 2.

First, the general structure of the piezoelectric sheet 10 will be described. FIG. 18 shows a top view of the piezoelectric sheet 10. The piezoelectric sheet 10 is provided with a plurality of substantially rhombus driving electrodes 11 that are arranged on the piezoelectric sheet in matrix at density corresponding to the printing resolution required for the inkjet head 1. The driving electrodes 11 are formed at positions corresponding to the ink pressure chambers 911 of the cavity plate 900, respectively. Thus, the driving electrodes 11 are located above respective ink pressure chambers 911 when the piezoelectric sheet 10 is laid on top of the cavity plate 900 to close the upper side of each ink pressure chamber 911.

Figure 19:
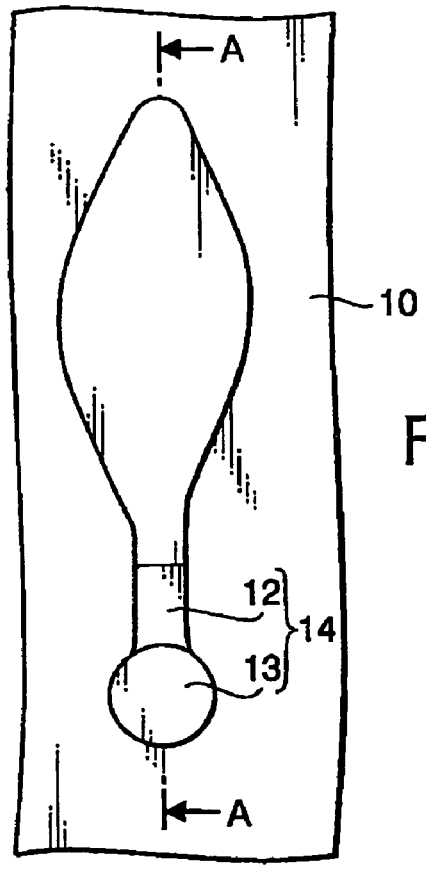
FIG. 19 shows a top view of a driving electrode formed on the piezoelectric sheet shown in FIG. 18.
Figure 20:
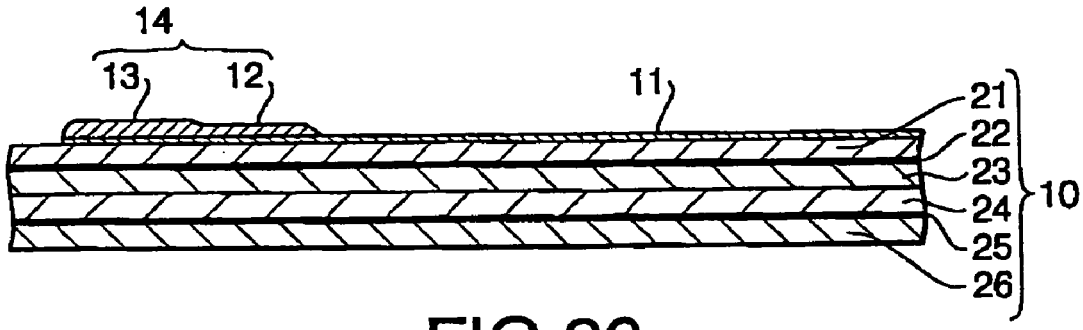
FIG. 20 shows a sectional view of a part of the piezoelectric sheet taken along a line A—A of FIG. 19.

FIG. 19 shows an enlarged top view of the driving electrode 11, and FIG. 20 shows a sectional view of a part of the piezoelectric sheet 10 taken along the line A—A in FIG. 19.

As shown in FIG. 19, a contact land 14 extends from one of the acute angle corners of the driving electrode 11 so as to be located in a vicinity of the driving electrode 11. The contact land portion 14 is formed in two-tier structure having a first level portion 12, formed higher than the driving electrode 11, and a second level portion 13 higher than the first level portion 12. The first level portion 12 is formed between the second level portion 13 and the driving electrode 11.

As shown in FIG. 20, the piezoelectric sheet 10 has a laminated structure in which a first piezoelectric layer 21, a second piezoelectric layer 23, a third piezoelectric layer 24, and a fourth piezoelectric layer 26 are laminated. An inner electrode 22 is formed between the first piezoelectric layer 21 and the second piezoelectric layer 23, and an inner electrode 25 is formed between the third piezoelectric layer 24 and the fourth piezoelectric layer 26. The ends of the inner electrodes 22 and 25 are exposed on the oblique side surfaces of the piezoelectric sheet 10. Note that the piezoelectric sheets 10 are attached on the cavity plate 900 so as to make contact with each other at the oblique side surfaces thereof. Thus, the inner electrodes 22 and 25 of the piezoelectric sheets 10 are electrically connected to each other.

Referring back to FIG. 18, a plurality of first common electrodes 31 and a plurality of second common electrodes 36 are alternately formed on the top face of each piezoelectric sheet 10 along the oblique sides thereof.

Figure 21:
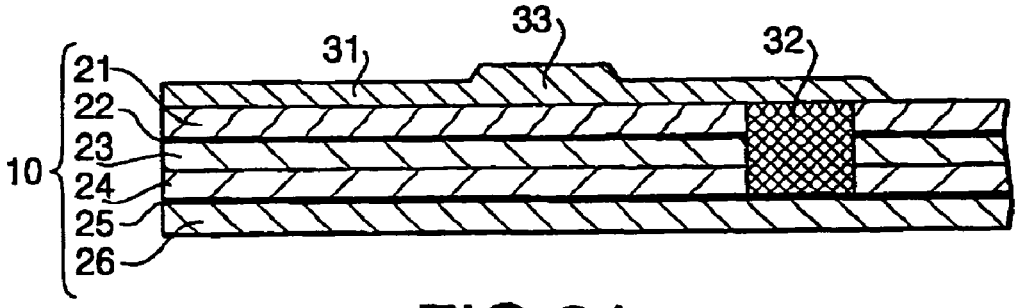
FIG. 21 shows a sectional view of the piezoelectric sheet at a portion thereof including a first common electrode.

FIG. 21 shows a sectional view of the piezoelectric sheet 10 at a portion thereof including one of the first common electrodes 31. As shown in FIG. 21, the first common electrode 31 is electrically connected with the inner electrode 25 formed between the third piezoelectric layer 24 and the fourth piezoelectric layer 26 via a through hole 32. Further, the first common electrode 31 is provided with a protrusion 33, which serves as a contact land 33.

Figure 22:
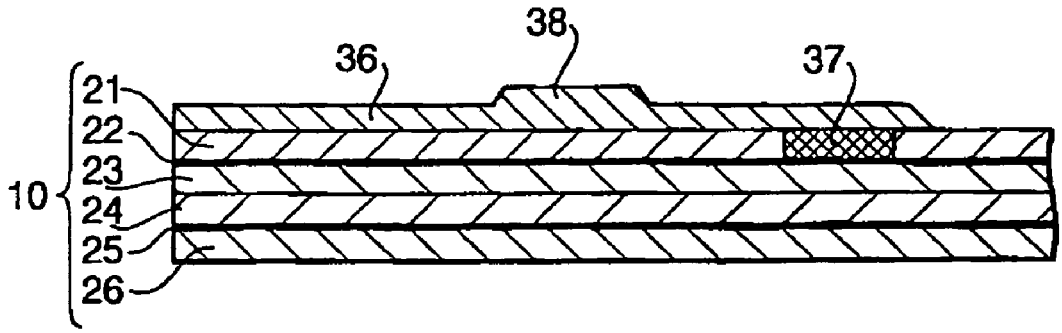
FIG. 22 shows a sectional view of the piezoelectric sheet at a portion thereof including a second common electrode.

FIG. 22 shows a sectional view of the piezoelectric sheet 10 at a portion thereof including one of the second common electrodes 36. As shown in FIG. 22, the second common electrode 36 is electrically connected with the inner electrode 22 formed between the first piezoelectric layer 21 and the second piezoelectric layer 23 via a through hole 37. Further, the second common electrode 36 is provided with a protrusion 38, which serves as a contact land 38.

Referring back to FIG. 18, each piezoelectric sheet 10 is provided with positioning marks 46 formed on the top face thereof in a vicinity of each oblique side. These position marks 46 assist in positioning the piezoelectric sheet 10 on the cavity plate 900. Further, each piezoelectric sheet 10 is provided with a plurality of circular dummy electrodes 41 formed on the top face thereof. The dummy electrodes are arranged along imaginary lines L1 and L2 defined in vicinities of and in parallel to the upper and lower sides, or parallel sides, of the trapezoidal piezoelectric sheet 10.

Figure 23:
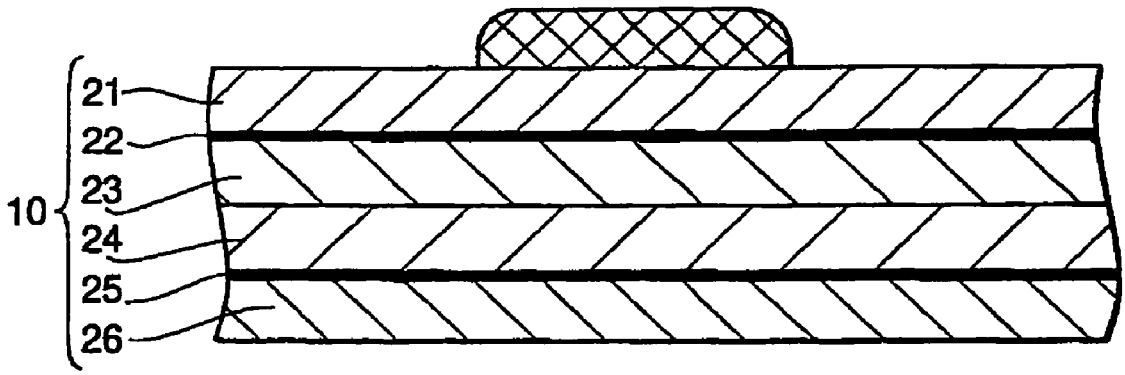
FIG. 23 is a sectional view of the piezoelectric sheet at a portion thereof including a dummy electrode.

FIG. 23 is a sectional view of the piezoelectric sheet 10 at a portion thereof including one of the dummy electrodes 41. As shown in FIG. 23, the dummy electrode 41 is not connected with either of the inner electrodes 22 or 25.

Next, the general structure of the FPC board 50 will be described.

Figure 24:
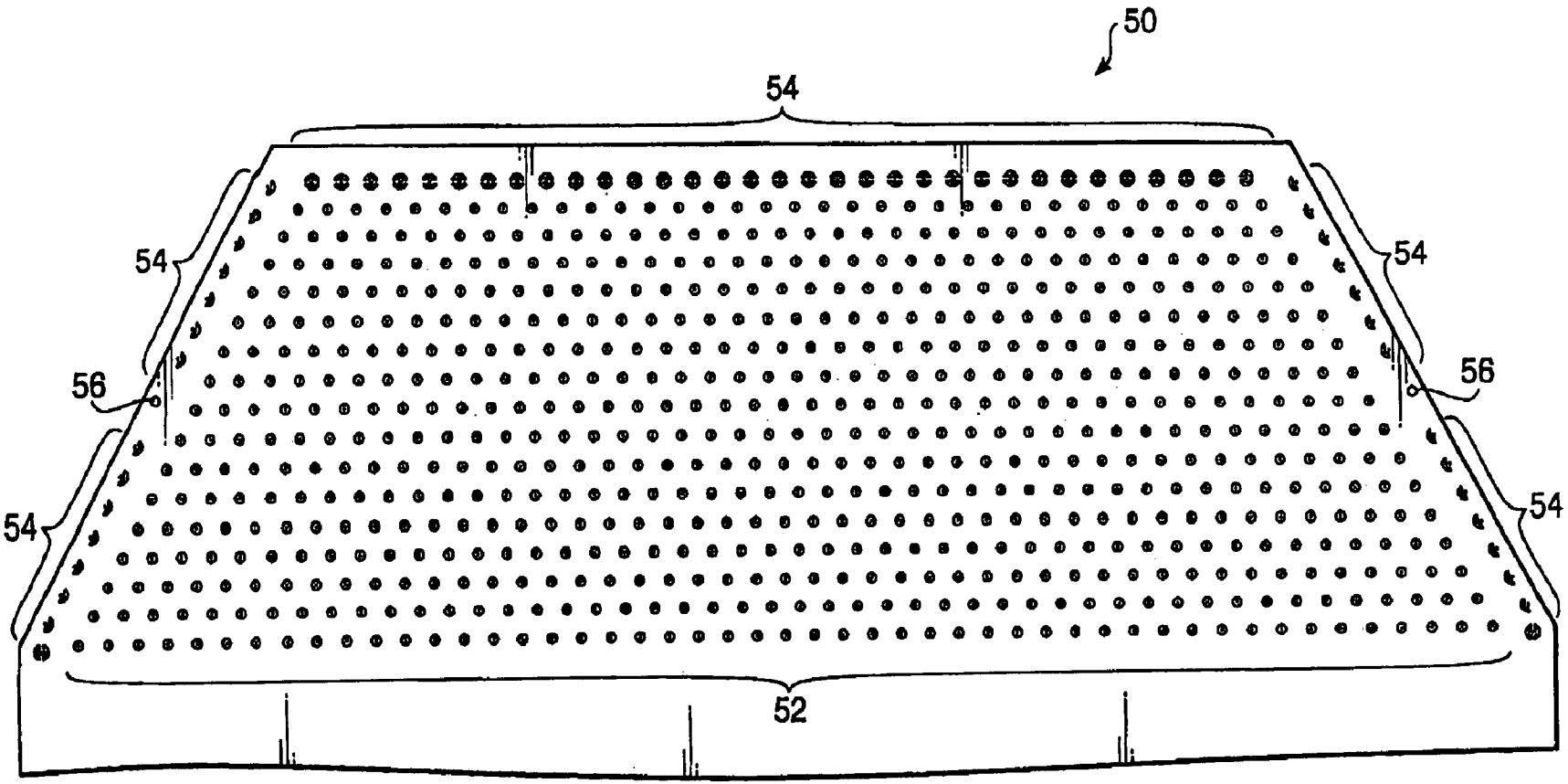
FIG. 24 is a plane view of an extended portion of a flexible printed board (FPC board) of the inkjet head shown in FIG. 2.
Figure 25:
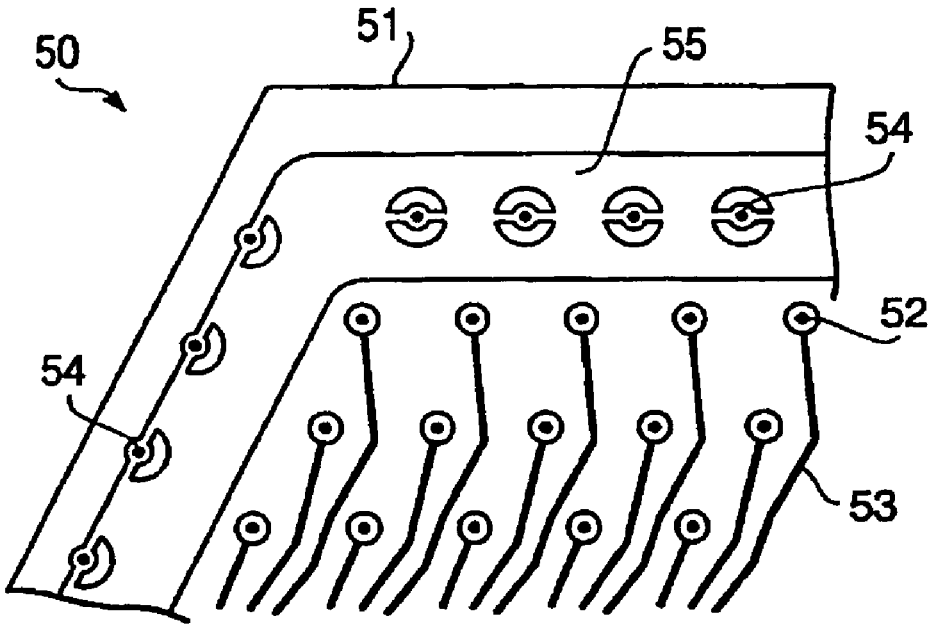
FIG. 25 is an enlarge view of a part of the extended portion of the FPC board shown in FIG. 24.

FIG. 24 is a plane view of the extended portion 51 of the FPC board 50, and FIG. 25 is an enlarged view of a part of the extended portion 51 of the FPC board 50.

As shown in FIG. 24, the FPC board 50 is provided with a plurality of contact lands 52 formed on the extended portion 51 thereof. The contact lands 52 are formed at positions corresponding to the second level portions 13 of the driving electrodes 11 on the piezoelectric sheet 10. Thus, when the FPC board 50 is attached on the piezoelectric sheet 10, the contact lands 52 come into contact with the driving electrodes 11 at the second level portions 13 thereof.

Each contact land 52 is connected with a conductive pattern 53 made of copper foil, as shown in FIG. 25. Note that the conductive patterns 53 are omitted in FIG. 24 for simplicity.

As shown in FIG. 24, a plurality of contact lands 54 are formed on the extended portion 51 of the FPC board 50 along the tip end and both oblique sides thereof. The contact lands 54 arranged along the tip end of the extended portion 51 are located at positions corresponding to respective ones of the dummy electrodes 41 formed on the piezoelectric sheet 10 along the imaginary line L1 (see FIG. 18) so as to make contact therewith when the FPC board 50 is attached on the piezoelectric sheet 10. The contact lands 54 arranged along the oblique sides of the extended portion 51 of the FPC board 50 are located at positions corresponding to respective ones of common electrodes 31 and 36 formed alternately along the oblique sides of the piezoelectric sheet 10 so as to make contact therewith as the FPC board 50 is attached on the piezoelectric sheet 10.

Note that, as shown in FIG. 25, each of the contact lands 54 is electrically connected to a conductive pattern 55 made of copper foil.

Figure 26:
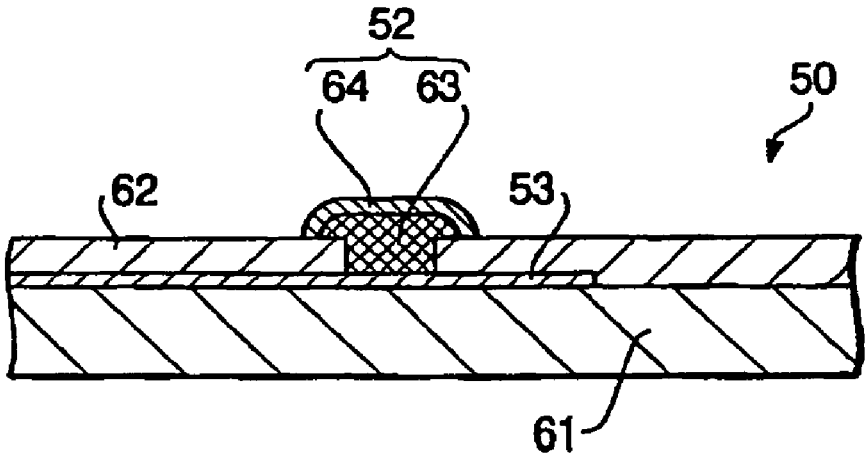
FIG. 26 shows a sectional view of the FPC board at a portion thereof including a contact land.

FIG. 26 shows a sectional view of the FPC board 50 at a portion thereof including one of the contact lands 52. The FPC board 50 includes a base film 61 such as a polyimide film, the conductive patterns 53, and a cover layer 62. The conductive patterns 53 is formed on the base film 61, and the cover layer 62 extends over the base film 61 and the conductive patterns 53. The cover layer 62 is provided with a plurality of holes formed therethrough at positions near the end portions of the conductive patterns 53. The holes are filled with nickel 63 formed by plating. The portion of the nickel 63 protruding from the hole is covered with solder 64. The nickel 63 and the solder 64 constitute the contact land 52 of the FPC board 50.

It should be noted that the contact lands 54 formed along the tip end and oblique sides of the extended portions 51 of the FPC board 50 and the conductive pattern 55 connected thereto have substantially the same configurations as the contact lands 52 and the conductive patterns 53.

Figure 27:
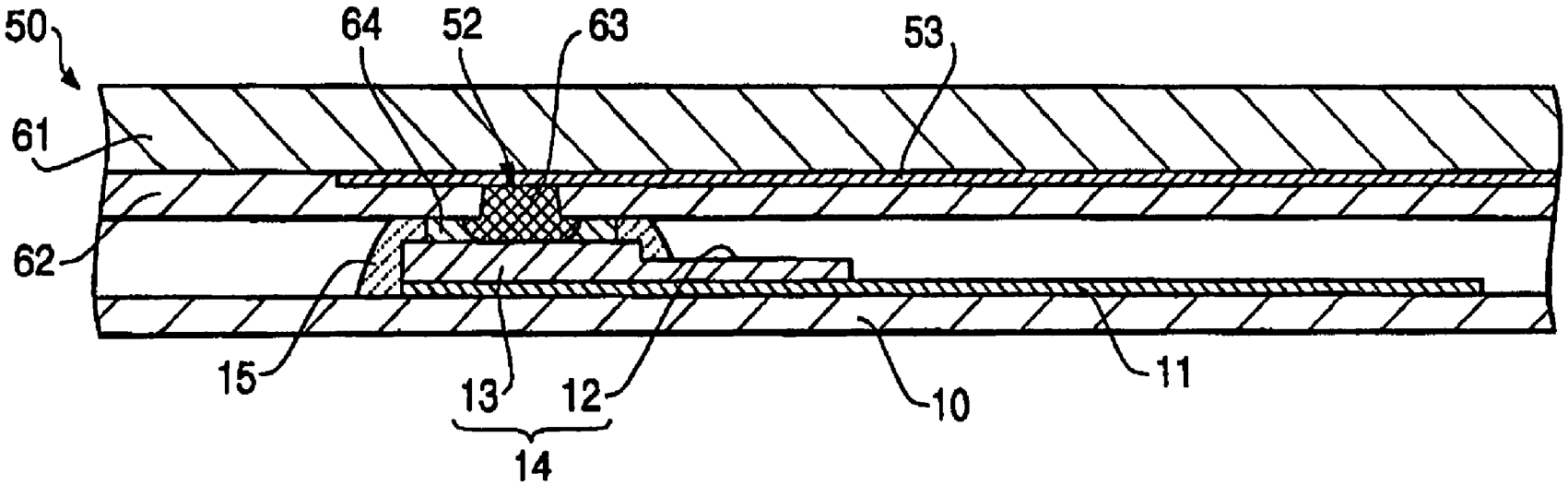
FIG. 27 a sectional view of the FPC board and the piezoelectric sheet showing contact lands thereof connected to each other.

Referring back to FIG. 24, the extended portion 51 of the FPC board 50 is provided with positioning marks 56 formed in a vicinity of each oblique side thereof to assist in positioning the extended portion 51 on the piezoelectric sheet 10. That is, if the extended portion 51 of the FPC board 50 is placed on the piezoelectric sheet 10 such that the positioning marks 56 thereon are aligned with the positioning marks 46 on the piezoelectric sheet 10, each contact land 52 of the FPC board 50 is placed on the second level portion 13, or contact land 14, of the corresponding driving electrode 11 of the piezoelectric sheet 10. Thus, each contact land 52 (or nickel portion 63 and solder portion 64) of the FPC board 50 can be fixed onto the corresponding driving electrode 11 (or the second level portion 13) of the piezoelectric sheet 10 by means of compression thermo, for example, so as to establish electrical connection therebetween, as shown in FIG. 27.

When the contact land 52 of the FPC board 50 and the contact land 14 of the driving electrode 11 of the piezoelectric sheet 10 are connected with each other as described above, the contact land 52 (the nickel portion 63 and solder portion 64) and the second level portion 13 of the contact land 14 are covered with non-conductive paste (N.C.P.) 15. The N.C.P. 15 melted by the heat applied to the contact land 52 partially flows onto the first level portion 12 of the contact land 14. The solder 64 also melts and partially flows toward the driving electrode 11. The first level portion 12, however, prevents the solder 64 from further flowing down onto the driving electrode 11, thereby keeps the driving electrode 11 from being corroded by the solder 64. It should be noted, however, that the amount of the solder 64 flowing toward the driving electrode 11 can vary from case to case. The N.C.P. 15 is provided to reliably prevent the solder 64 from flowing onto the driving electrode 11 even if a large amount of solder 64 flows toward the driving electrode 11. Further, the N.C.P. 15 also serves as an adhesive for enhancing the joining strength between the FPC board 50 and the piezoelectric sheet 10.

Further, when the extended portion 51 of the FPC board 50 is placed on the piezoelectric sheet 10 such that the positioning marks 56 on the FPC board 50 are aligned with the positioning marks 46 on the piezoelectric sheet 10, the contact lands 54 of the FPC board 50 contact the dummy electrodes 41 of the piezoelectric sheet 10, which are formed along the imaginary line L1 and with the protrusions 33, 38 of the common electrodes 31, 36 formed alternately along each oblique sides of the piezoelectric sheet 10. Thus, for example, the contact lands 54 can be electrically connected with the dummy electrodes 41 and the common electrodes 31, 36 by means of thermo compression.

After the FPC boards 50 are connected with the piezoelectric sheets 10, as described above, the driving voltage can be applied between the driving electrodes 11 and the inner electrodes 22, 25 through the FPC board 50 to deform the first, second, third, and forth piezoelectric layers 21, 23, 24 26, respectively at portions directly below each driving electrode 11.

Each portion of the first piezoelectric layer 21, defined immediately below each driving electrode 11, serves as an active portion that bends when voltage is applied to the corresponding driving electrode 11.

It should be noted that the piezoelectric sheet 10 may bend or deform into a wavy form during the sintering process thereof, since the shrinking percentage differs between the piezoelectric material of the first through fourth piezoelectric layers 21, 23, 24, 26 and the metallic material of the inner electrodes 22, 25. The inner electrode 25 is provided between the third and fourth piezoelectric layers 24, 26 so as to serve as a restraint layer that prevents the first through fourth piezoelectric layers 21, 23, 24, 26 from bending or deforming into a wavy form and thereby keeping the piezoelectric sheet 10 flat. Further, the second, third and fourth piezoelectric layers 23, 24, 26 serve as restraint layers that force the active portions of the first piezoelectric layer 21 to bend only downward (i.e., toward the cavity plate 900).

Next, the flow of the ink within the inkjet head 1 configured as above will be described.

Figure 29:
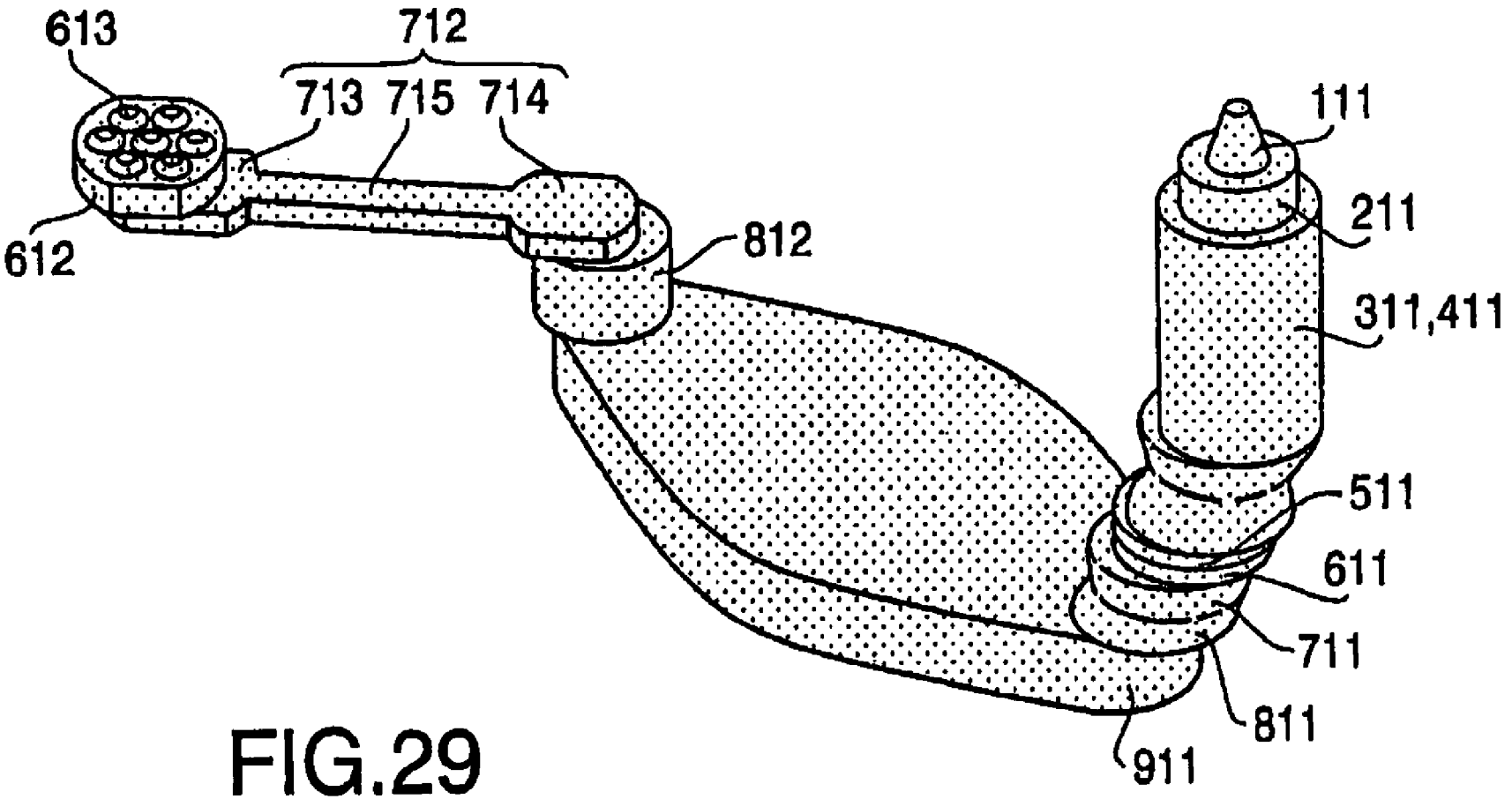
FIG. 29 is a perspective view of the ink channel shown in FIG. 28.
Figure 30:
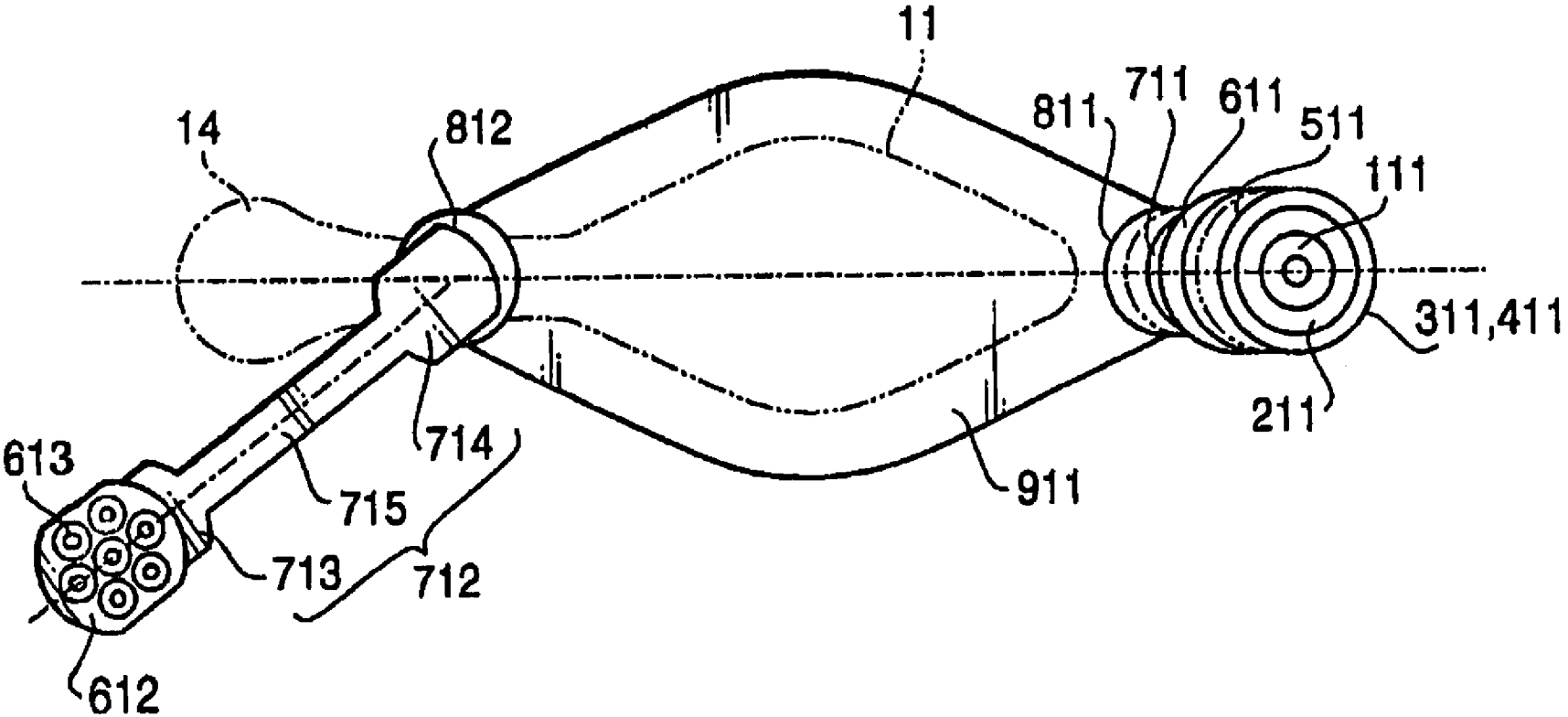
FIG. 30 is a plane view of the ink channel shown in FIG. 29 observed from the nozzle side thereof.

FIG. 28 is a sectional view of a part of the inkjet head 1 showing a part of an ink channel extending from one of the nozzles 111. FIG. 29 is a perspective view of the ink channel shown in FIG. 28, and FIG. 30 is a plane view of the ink channel shown in FIG. 29 observed from the nozzle side thereof.

Referring now to FIGS. 3, 28, 29, and 30, the ink to be ejected from the ink-jet head 1 is first supplied from an ink tank (not shown) into the manifold channels 20 through the ink supply channels each consisting of the ink supply openings 901, 801, 701 and 601 (see FIG. 3). Note that foreign particles within the ink are prevented from entering the manifold channels 20 by the filter holes 602 as the ink flows through the ink supply openings 601 of the supply plate 600 (see also FIG. 13).

Referring to FIG. 28, the side walls of the manifold channels 20 consist of the side walls of the openings 312, 412, 512 of the first, second, and third manifold plates 300, 400, 500, respectively. Further, the upper surfaces of the manifold channels 20 are defined by the supply plate 600, while the under surfaces are defined by the cover plate 200.

Figure 31:
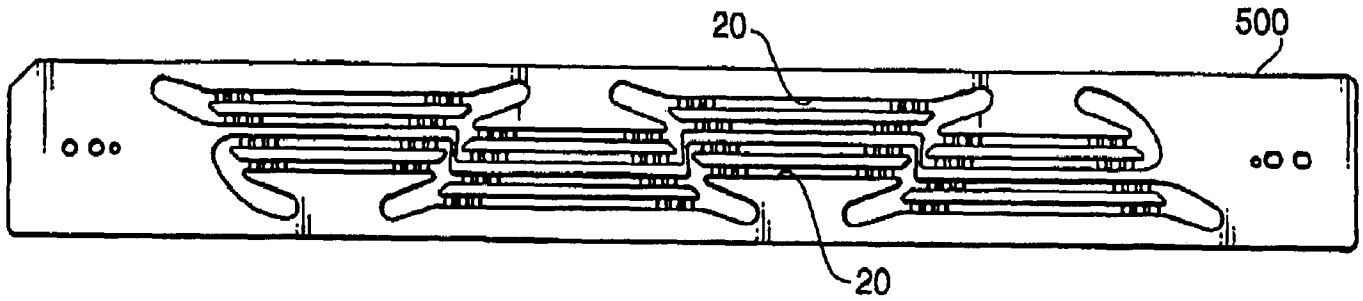
FIG. 31 is a top view of two manifold channels of the inkjet head shown in FIG. 2.
Figure 32:
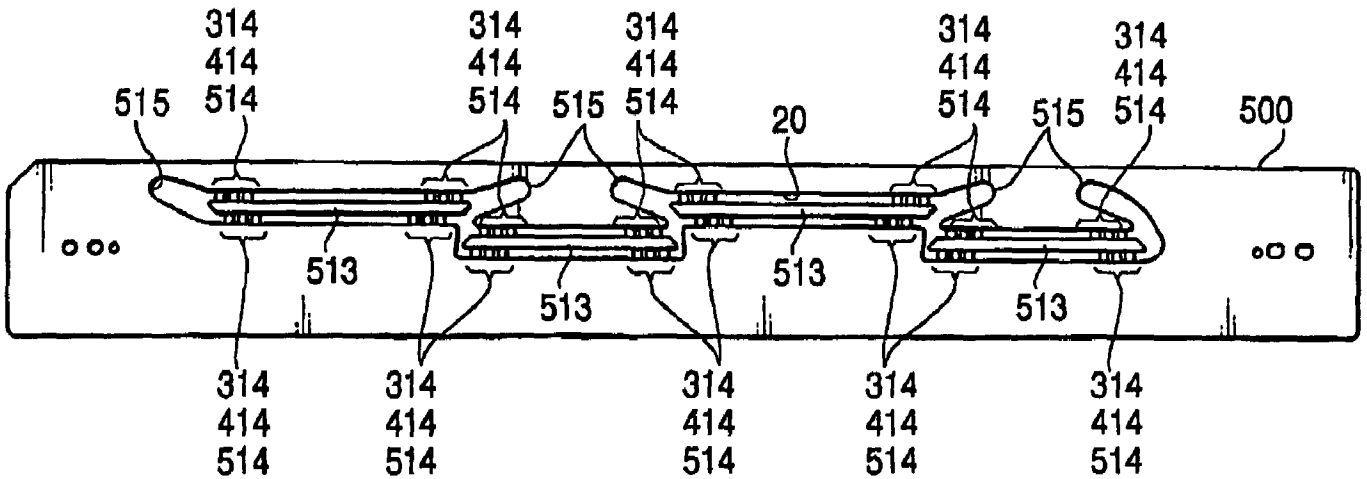
FIGS. 32 and 33 respectively show a top view of one of the manifold channels shown in FIG. 31.
Figure 33:
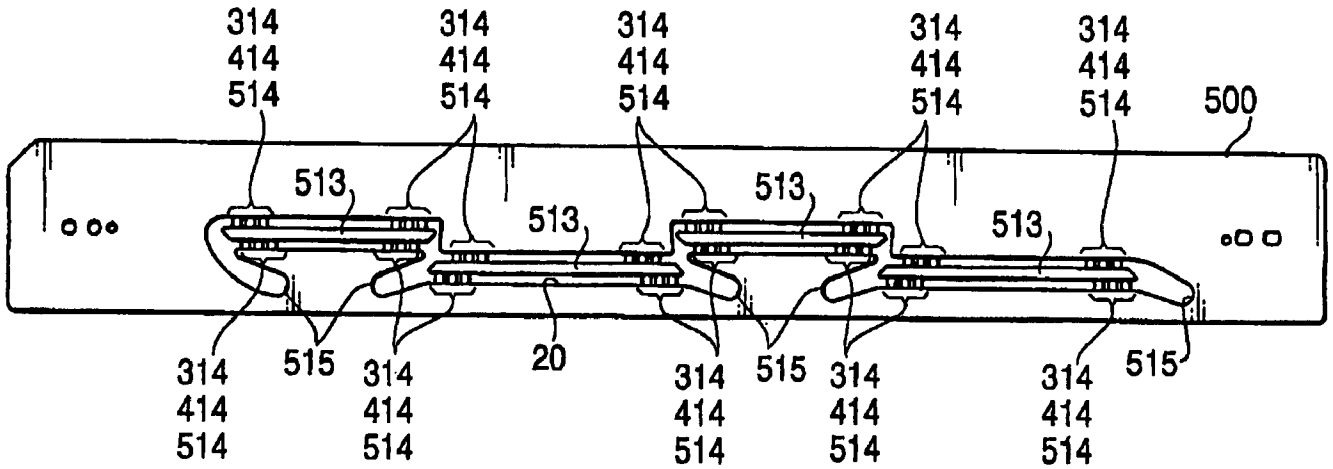

FIG. 31 is a top view of the manifold channels 20 formed in the inkjet head 1. As shown in FIG. 31, two manifold channels 20 are formed in the inkjet head 1, one in the upper half of the inkjet head 1 in the width direction thereof, as shown in FIG. 32, and the other one in the lower half, as shown in FIG. 33. Each manifold channel 20 has five ink supply portions, each consisting of the ink supply portions 315, 415, 515 of the first, second, and third manifold plates 300, 400, 500 (see FIGS. 7, 8, 9), respectively.

The land portions 313, 413, 513 of the first, second, and third manifold plates 300, 400, 500, respectively, are formed in substantially the same shape and at substantially the same locations. Thus, the land portions 313, 413, 513 are aligned with each other in the lamination direction of the inkjet head 1 to form land blocks, which are encircled with the ink, in the manifold channels 20 that extend between the top surface of the cover plate 200 and the under surface of the supply plate 600. The land blocks are composed of the land portions 313, 413, 513 define closed loops in the manifold chambers 20. Each closed loop is defined around one of the land blocks. Thus, a pressure wave generated in the ink in the manifold chambers 20 can transmit around the land blocks composed of the land portions 313, 413, 513.

Figure 34:
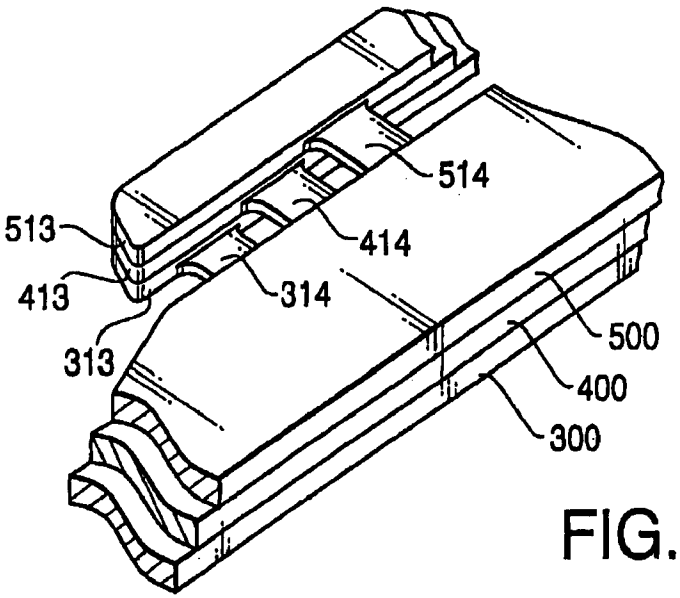
FIG. 34 is a perspective view of a part of the manifold channel.

The connection beams 314, 414 514 supporting the land portions 313, 413 513 are located so as not to overlap each other (viewed in the lamination direction of the inkjet head 1 as shown in FIG. 34). Thus, the connection beams 314, 414, 514 do not significantly reduce the cross section of the manifold chambers 20 and hence do not hinder the pressure wave in the ink from smoothly transmitting around the land blocks composed of the land portions 313, 414, 514.

Referring back to FIG. 28, the ink supplied to the manifold channel 20 is next introduced into each ink pressure chamber 911 of the cavity plate 900 through the corresponding filter portion 612 of the supply plate 600, the restriction portion 712 of the aperture plate 700, and the through hole 812 of the base plate 800. Note that foreign particles have been removed from the ink, and thereby prevented from entering the ink pressure chamber 911, as the ink flows through the filter portion 612 by the filter holes 613 thereof (see FIGS. 11 and 12).

The upper side of the ink pressure chamber 911 is closed by the piezoelectric sheet 10 attached on the cavity plate 900. The piezoelectric sheet 10 is placed on the cavity plate 900 such that the driving electrodes 11 are located directly above the respective ink pressure chambers 911. As shown in FIG. 30, each of the substantially rhombus driving electrodes 11 is located within a substantially rhombus area defined right above the corresponding ink pressure chamber 911. Further, the contact land 14 formed on the portion of the driving electrode 11 extending from one acute angle corner thereof is located outside the substantially rhombus area defined right above the ink pressure chamber 911.

When driving voltage is applied between the driving electrode 11 and the inner electrodes 22, 25 of the piezoelectric sheet 10, the piezoelectric sheet 10 deforms (bends) toward the cavity plate 900, resulting in pressurizing of the ink in the ink pressure chamber 911. The pressurized ink flows through the through holes 811, 711, 611, 511, 411, 311, 211 of the base plate 800, the aperture plate 700, the supply plate 600, the third manifold plate 500, the second manifold plate 400, the first manifold plate 300, and the cover plate 200, and is ejected from the nozzle 111 of the nozzle plate 100.

As previously described, one of the manifold channels 20 is formed in the upper half of the inkjet head 1 in the width direction, while the other one is formed in the lower half (see FIGS. 32 and 33). The manifold channel 20 in the upper half of the inkjet head 1 is in fluid communication with all of the ink pressure chambers 911 formed on the upper half of the cavity plate 900 through the through holes 612, the restriction portions 712 and the through holes 812 formed on the upper halves of the supply plate 600, the aperture plate 700, and the base plate 800, respectively. Further, the manifold channel 20 in the lower half of the inkjet head 1 is in fluid communication with all of the ink pressure chambers 911 formed on the lower half of the cavity plate 900 through the through holes 612, the restriction portions 712 and the through holes 812 formed on the lower halves of the supply plate 600, the aperture plate 700, and the base plate 800, respectively. Accordingly, the ink supplied into the manifold channels 20 is distributed to all ink pressure chambers 911 so that the ink can be ejected from any of the nozzles 111.

As described above, each manifold channels 20 is in fluid communication with multiple ink pressure chambers 911. Thus, when pressure is applied to one of the ink pressure chambers 911 by the piezoelectric sheet 10 in order to eject ink from the corresponding nozzle 111, a pressure wave transmits from that ink pressure chamber 911 to the corresponding manifold channel 20. Further, a part of the pressure wave may transmit into other ink pressure chambers 911, (e.g., ones adjacent to the pressurized one), and thereby break the ink meniscuses formed in the ink channels connecting the adjacent ink pressure chambers 911 to the corresponding nozzles 111. The breakage of the ink meniscus is undesirable since it allows air entering the ink channel and disturbing stable ink ejection.

In an exemplary embodiment, however, since each manifold channel 20 is formed to have an annular shape so as to include closed loops therein, the pressure waves transmitted into the manifold channel 20 circulates along the closed loops and are not superimposed, and accordingly do not transmit into the ink pressure chambers 911, (e.g., ones adjacent to the pressurized one). Accordingly, the ink meniscuses formed in the ink channels extending from those ink pressure chambers 911 do not break due to the pressure wave.

As previously described, the connection beams 314, 414, 514 of the first, second, and third manifold plates 300, 400, 500 are formed by half-etching. Thus, the connections beams 314, 414, 514 are thinner than the first, second, and third manifold plates 300, 400, 500 and the land portions 313, 413, 513 thereof. Such thin connection beams 314, 414, 514 do not prevent the pressure waves in the ink from transmitting along the closed loops defined in the manifold channels 20.

Further, the connection beams 314, 414, 514 of the first, second, and third manifold plates 300, 400 500 are formed so as not to overlap each other (viewed in the lamination direction of the inkjet head 1). This arrangement reduces the resistance of the connections beams 314, 414, 514 against the pressure wave transmitting in the ink along the manifold channel 20 compared to that in the case the connection beams 314, 414, 514 are aligned in the lamination direction of the inkjet head 1. It should be noted that the manifold channel 20 will not be blocked with the connection beams 314, 414, 514 even if they are aligned along the lamination direction of the inkjet head 1 since each connection beam is made thinner than the corresponding manifold plate 300, 400, 500. However, the pressure wave cannot smoothly transmit through the connection beams 314, 414, 514 in this case since the gaps between them are quite small.

It should be noted that each manifold channels 20 of the inkjet head 1 according to the present embodiment is connected with more than one ink supply channels, each of which consists of the ink supply openings 601, 701, 801, 901. Thus, even if one of the ink supply channels is clogged, ink can be supplied from the external ink tank into each manifold channel 20 to keep stable ink ejection of the inkjet head 1.

As previously described, pressure waves occur in the manifold channel 20 when ink is supplied thereto from the external ink tank through the ink supply channel 601, 701, 801, 901. In an exemplary embodiment, the manifold channel 20 allows the pressure waves to circulate along the closed loops defined therein and hence does not reflect them back. Accordingly, superposition of reflected pressure waves on subsequent pressure waves, which causes insufficient or excessive pressure inside the ink pressure chambers 911 and hence unstable ink ejection from the inkjet head 1, does not occur in the manifold channel 20.

While the invention has been described in detail with reference to a specific embodiment thereof, it would be apparent to those skilled in the art that various changes and modifications may be made therein without departing from the scope of the invention, the scope of which is defined by the attached claims.

Figure 35:
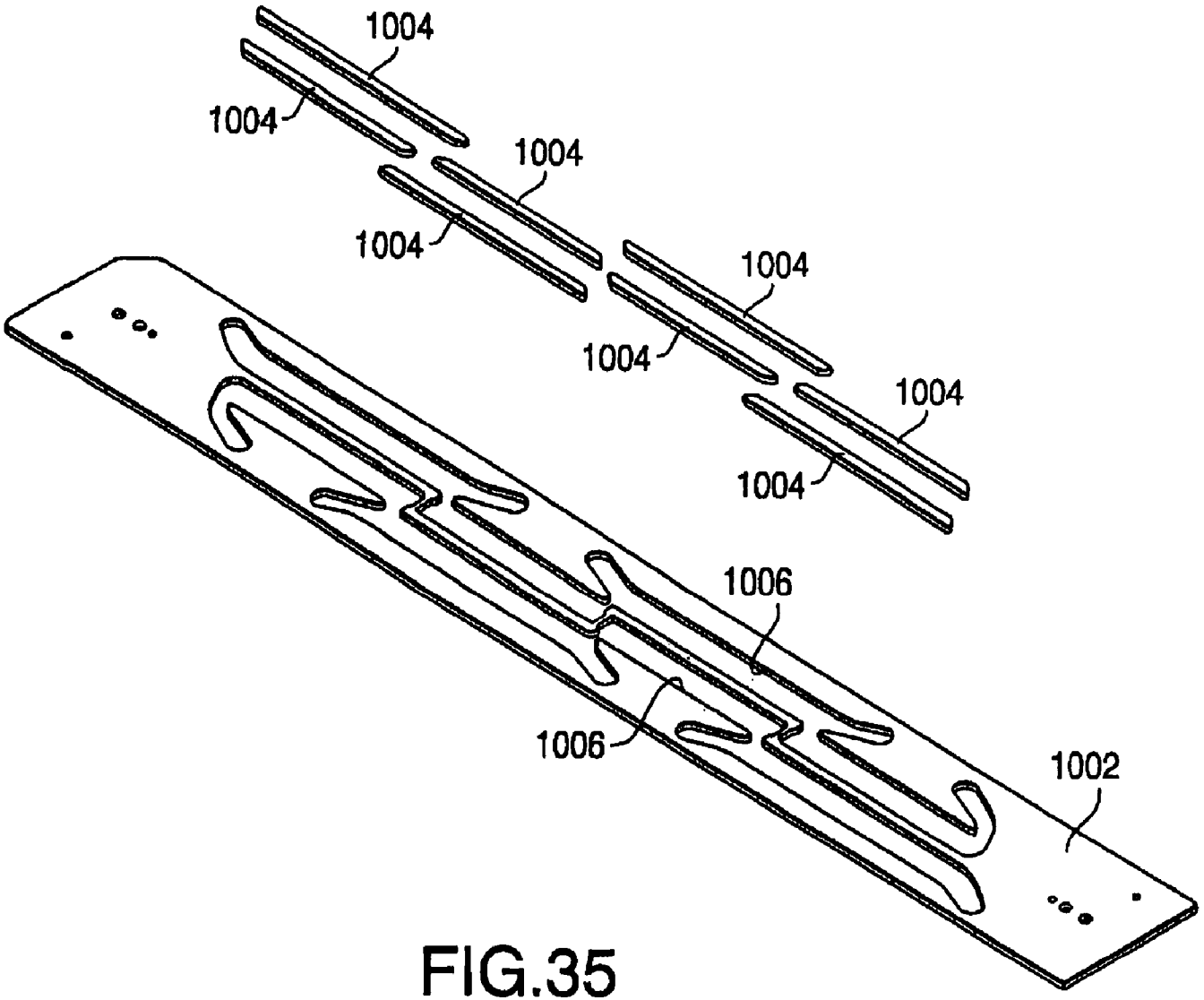
FIG. 35 shows a perspective view of a modified manifold plate.

For example, more than one of the first, second, and third manifold plates 300, 400, 500 may be replaced with a manifold plate 1002 and eight separate plate pieces 1004 shown in FIG. 35. The manifold plate 1002 has substantially the same shape as the first, second, and third manifold plates 300, 400, 500 except that it is not provided with the land portions 313, 413, 513 and the connection beams 314, 414, 515. In other words, the manifold plate 1002 is a substantially rectangular plate that is formed with two openings 1006 that has substantially the same shapes and located at substantially the same locations as the openings 312, 412, 512 formed in the first, second, and third manifold plates 300, 400, 500.

The separate plate pieces 1004 has substantially the same shape as the land portions 313, 413, 513 formed in the first, second, and third manifold plates 300, 400, 500. When the manifold plate 1002 is used as an alternative of one of the first, second, and third manifold plate 300, 400, 500, the separate plate pieces 1004 are located in the openings 1006 at locations corresponding to the land portions 313, 413, 513 so as to define closed loops in the manifold channels formed by the opening 1006.

Figure 39:
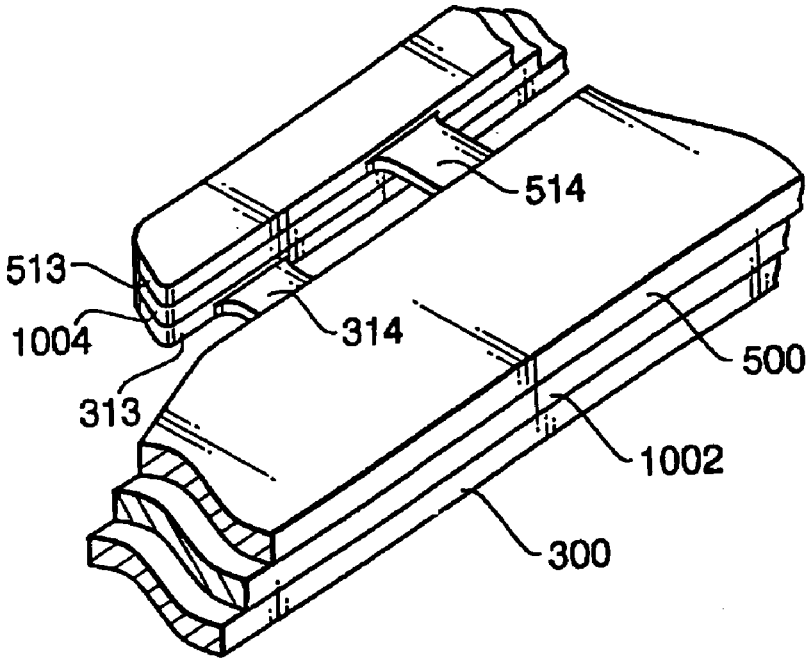
FIG. 39 is a perspective view of a part of the manifold channel according to a modification of the embodiment.

For example, if the second manifold plate 400 is replaced with the manifold plate 1002, the separate plate pieces 1004 are placed in the openings 1006 of the manifold plate 1002 so that-each separate plate piece 1004 is sandwiched between the corresponding land portions 313, 513 of the first and third manifold plates 300, 500 as shown in FIG. 39.

The manifold plate 1002 and the separate plate pieces 1004 shown in FIG. 35 are advantageous in that they do not require half-etching of the manifold plate 1002 for forming the connections beams 314, 414, 514 therein.

Figure 36A:
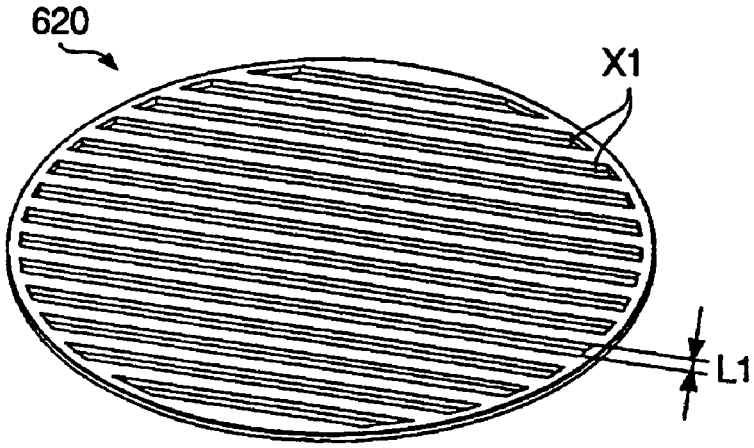
FIGS. 36A, 36B, and 36C show filter portions that may be formed in an ink supply channel of the inkjet head shown in FIG. 2.
Figure 36B:
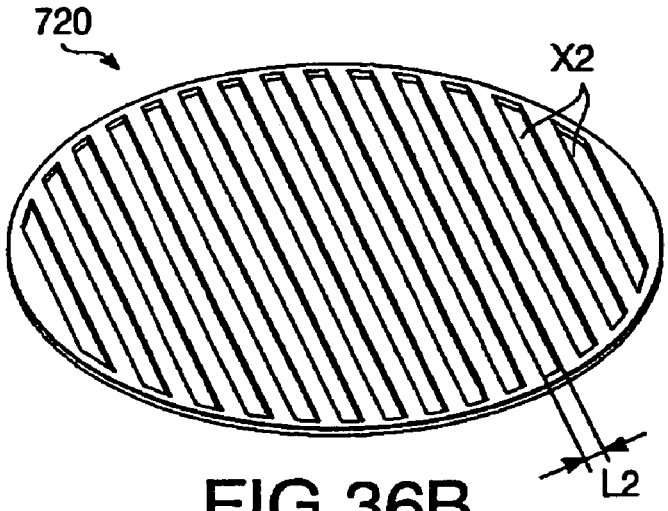
Figure 36C:
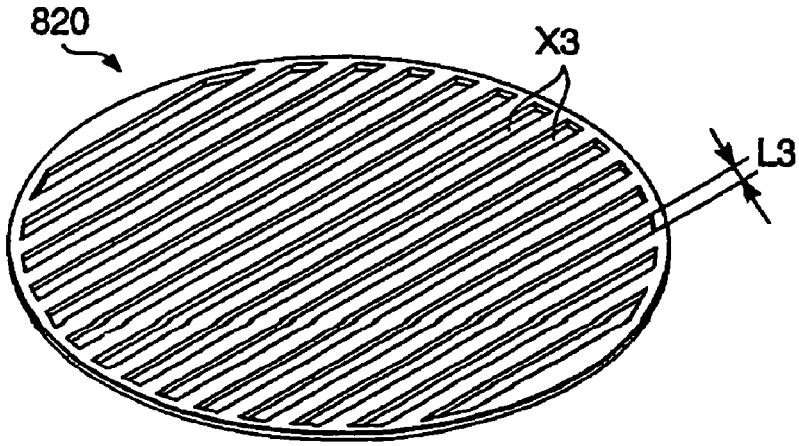

It should be noted that each ink supply opening 601 of the supply plate 600 may be formed with a filter portion 620, shown in FIG. 36A, instead of with the filter holes 602 shown in FIG. 13. In this case, each ink supply opening 701 of the aperture plate 700 is formed with a filter portion 720 shown in FIG. 36B, and each ink supply opening 801 of the base plate 800 is formed with a filter portion 820 shown in FIG. 36C.

The filter portion 620 has a plurality of slits X1 formed in parallel to each other and at regular intervals. Each slit X1 has a width L1 of about 50 μm. The slits X1 are formed through the supply plate 600 by etching. Thus, the slits X1 can be obtained easily and in low cost.

The filter portions 720, 820 have substantially the same configuration as the filter portion 620 except the directions in which the slits X2 and X3 thereof extend. That is, the filter portions 620, 720, 820 are formed such that the slits X1, X2, and X3 intersect with each other at an angle of about 60° when the ink supply plate 600, the aperture supply plate 700, and the base plate 800 are stacked on each other.

Figure 37:
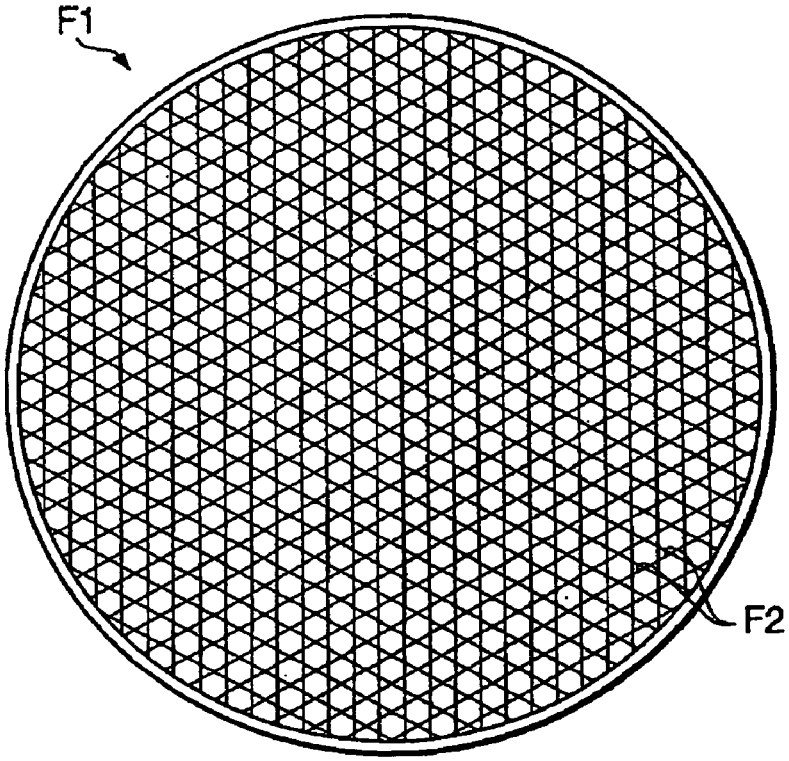
FIG. 37 is a top view of a filter composed of the filter portions shown in FIGS. 36A, 36B, and 36C.

FIG. 37 shows a top view of a filter F1 consisting of the filter portions X1, X2, X3 stacked on each other. As shown in FIG. 37, the slits X1, X2, X3 intersecting with each other form a plurality of filter holes F2 for removing foreign particles from the ink passing therethrough. Since the slits X1, X2, X3 intersect with each other at an angle of about 60°, each of the filter holes F2 is substantially a regular triangle.

Figure 38:
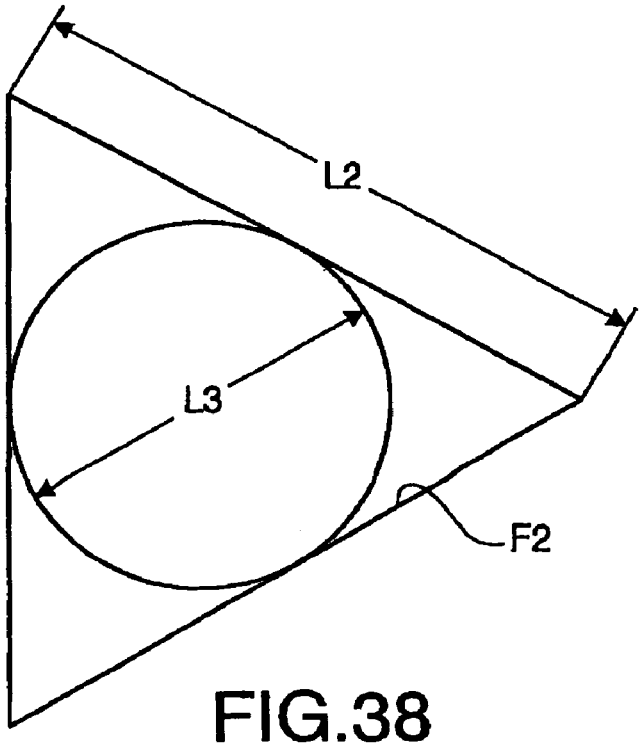
FIG. 38 schematically shows a filter hole of the filter shown in FIG. 37.

FIG. 38 schematically shows one filter hole F2 of the filter F1. Since the width of each of the slits X1, X2, X3 is about 50 μm, the in circle of filter hole F2 has a diameter of 16.7 μm. Therefore, the filter F1 does not allow foreign particles greater than 16.7 μm to pass therethrough.

It should be noted that forming accurately fine holes, such as the above mentioned filter holes F2, through a plate by etching, pressing, or the like is relatively difficult. On the contrary, the slits X1, X2, X3 can be formed by etching relatively easily and also accurately and hence allows the fine filter holes F2 to be formed with facility.

Figure 40:
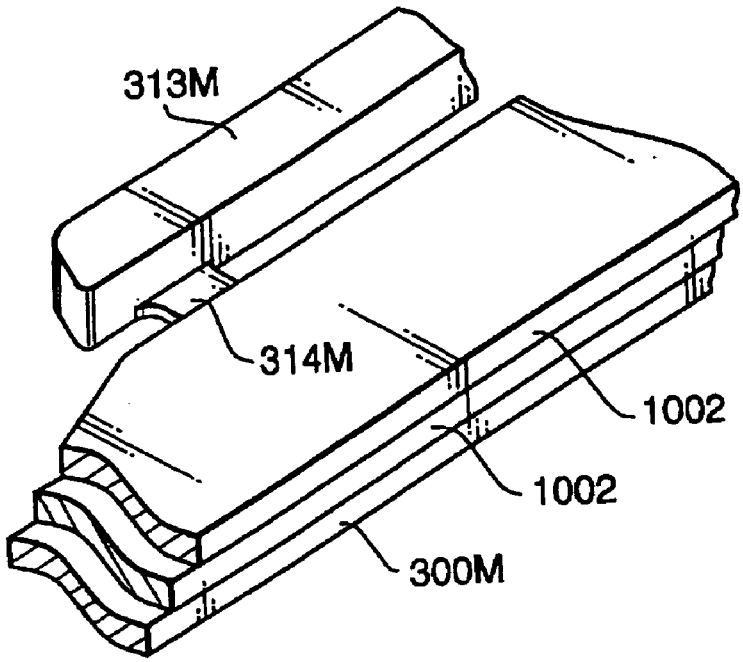
FIG. 40 is a perspective view of a part of the manifold channel according to a modification of the embodiment.

In a further example, the second manifold plate 400 and the third manifold plate 500 may be replaced with a manifold plate similar to the manifold plate 1002 (see FIG. 35) which is not formed with the land portion, and the first manifold plate 300 may be replaced with a modified manifold plate 300M, which is shown in FIG. 40. In this modification, a land portion 313M of the first manifold plate 300M has a thickness which is the sum of the thickness of the land portions 313, 413, 513 so that the a single land portion 313M form the land block as in the above-described embodiment. The land portion (or the land block) 313M is supported by one or plurality of beams 314M provided to the modified manifold plate 300M. It should be noted that such a land block may be formed to any one of the plurality of the manifold plates and the other manifold plates are formed not to have the land portions.

The present disclosure relates to the subject matters contained in Japanese Patent Applications Nos. P2002-281306 and P2002-281327, both filed on Sep. 26, 2002, which are expressly incorporated herein by reference in their entireties.

What is claimed is:

1. An inkjet head having a laminated structure of a plurality of plates including at least one cavity plate and at least one manifold plate, comprising:

a plurality of ink pressure chambers formed in said at least one cavity plate, each of said ink pressure chambers selectively pressurizing ink supplied thereto to eject the ink from said inkjet head;

a manifold channel formed in said at least one manifold plate, the manifold channel being in fluid communication with each of said ink pressure chambers to distribute the ink thereamong; and a land block provided in said manifold channel, said land block being encircled with the ink.

2. The inkjet head according to claim 1, wherein said inkjet head has a laminated structure of a plurality of plates including at least one manifold plate for defining said manifold channel, said at least one manifold plate having an opening formed therethrough, a land portion which is a portion of said at least one manifold plate left in said opening being provided within said opening, said opening of said at least one manifold plate defining said manifold channel, said land portion of at least one manifold plate forming said land block.

3. The inkjet head according to claim 2, wherein said opening is formed by etching said manifold plate.

4. The inkjet head according to claim 1, wherein said inkjet head has a laminated structure of a plurality of plates, said plates including a first manifold plate formed with an opening for defining said manifold channel, a separate plate piece being placed in said opening for forming said land block, said separate plate piece being supported by two of said plates sandwiching said first manifold plate.

5. The inkjet head according to claim 1, further comprising a plurality of plates including a plurality of manifold plates stacked on each other, wherein each of said plurality of manifold plates is formed with a through opening, the through openings of said plurality of manifold plates as stacked defining said manifold channel, and wherein said land block is supported by at least one supporting member that is provided to at least one of said plurality of manifold plates.

6. The inkjet head according to claim 1, comprising a plurality of ink supply channels connected to said manifold channel to supply ink from external ink supply to said manifold channel.

7. The inkjet head according to claim 1, wherein the manifold plate comprises a plurality of independent manifold channels.

8. An inkjet head, comprising:

a plurality of ink pressure chambers, each of said ink pressure chambers selectively pressurizing ink supplied thereto to eject the ink from said inkjet head;

a manifold channel being in fluid communication with each of said ink pressure chambers to distribute the ink thereamong; and a land block provided in said manifold channel, said land block being encircled with the ink, wherein said inkjet head has a laminated structure of a plurality of plates including at least one manifold plate for defining said manifold channel, said at least one manifold plate having an opening formed therethrough, a land portion which is a portion of said at least one manifold plate left in said opening being provided within said opening, said opening of said at least one manifold plate defining said manifold channel, said land portion of at least one manifold plate forming said land block, and wherein said land portion of said at least one manifold plate is supported with at least one beam formed on said at least one manifold plate, said at least one beam being thinner than said manifold plate.

9. The inkjet head according to claim 8, wherein said at least one beam is formed by etching said manifold plate in half-way of the thickness thereof.

10. An inkjet head, comprising:

a plurality of ink pressure chambers, each of said ink pressure chambers selectively pressurizing ink supplied thereto to eject the ink from said inkjet head;

a manifold channel being in fluid communication with each of said ink pressure chambers to distribute the ink thereamong; and a land block provided in said manifold channel, said land block being encircled with the ink, wherein said inkjet head has a laminated structure of a plurality of plates including a plurality of manifold plates stacked on each other, and wherein each of said manifold plates has an opening formed therethrough, a land portion which is a portion of said manifold plate left in said opening being provided within said opening, said opening of each of said manifold plates forming said manifold channel, said land portion of each of said manifold plates forming said land block.

11. The inkjet head according to claim 10, wherein said land portion of each of said manifold plates is supported with at least one beam formed on each of said manifold plates.

12. The inkjet head according to claim 11, wherein said beams of said plurality of manifold plates are formed on said manifold plates so as not to be completely overlapped when viewed in a direction in which said plurality of manifold plates are stacked.

13. The inkjet head according to claim 11, wherein said beams are formed thinner than respective manifold plates.

14. The inkjet head according to claim 13, wherein said beams are formed by etching said manifold plates in half-way of the thickness thereof.

15. The inkjet head according to claim 13, wherein a first manifold plate of the plurality of manifold plates is sandwiched between two second manifold plates of the plurality of manifold plates, each of said second manifold plates having an opening formed therethrough with a portion of said second manifold plate left in said opening, said portion being supported with a beam formed in said second manifold plate, and wherein said separate plate piece is held between said portions of said second manifold plates left in said openings thereof.

16. The inkjet head according to claim 15, wherein said openings of said first and second manifold plates have substantially the same shape.

17. The inkjet head according to claim 15, wherein said separate plate piece has substantially the same shape as the portion of said second manifold plate left in said opening thereof.

18. An inkjet head having a laminated structure of a plurality of plates including at least one cavity plate and at least one manifold plate, comprising:

a plurality of ink pressure chambers formed in said at least one cavity plate, each of said ink pressure chambers selectively pressurizing ink supplied thereto to eject the ink from said inkjet head; and a manifold channel formed to be an annular looped channel in said at least one manifold plate and being in fluid communication with each of said ink pressure chambers to distribute the ink thereamong.

19. The inkjet head according to claim 18, wherein the manifold plate comprises a plurality of independent manifold channels.

20. An inkjet head, comprising:

a plurality of ink pressure chambers, each of said ink pressure chambers selectively pressurizing ink supplied thereto to eject the ink from said inkjet head; and a manifold channel formed to be an annular looped channel and being in fluid communication with each of said ink pressure chambers to distribute the ink thereamong, wherein said inkjet head has a laminated structure of a plurality of plates including at least one manifold plate, said manifold plate having a substantially looped opening formed therethrough surrounding a portion of said manifold plate.

21. An inkjet head, comprising:

a plurality of ink pressure chambers, each of said ink pressure chambers selectively pressurizing ink supplied thereto to eject the ink from said inkjet head;

a manifold channel formed to be an annular looped channel and being in fluid communication with each of said ink pressure chambers to distribute the ink thereamong; and a laminated structure of a plurality of plates including a plurality of manifold plates stacked on each other, wherein each of said plurality of manifold plates is formed with a substantially looped opening surrounding a portion of each of said plurality of manifold plates, the looped openings of said plurality of manifold plates defining said manifold channel as said plurality of manifolds plates are stacked.

22. The inkjet head according to claim 21, wherein said portion of each of said plurality of manifold plates is connected to the manifold plate on which the said portion is provided using at least one beam across said looped opening.

23. The inkjet head according to claim 22, wherein said at least one beam is formed thinner than respective manifold plates.

24. The inkjet head according to claim 23, wherein said beams are formed by etching said manifold plates in halfway of the thickness thereof.

25. An inkjet head, comprising:

a plurality of ink pressure chambers, each of said ink pressure chambers selectively pressurizing ink supplied thereto to eject the ink from said inkjet head; and a manifold channel formed to be an annular looped channel and being in fluid communication with each of said ink pressure chambers to distribute the ink thereamong, wherein said looped opening of each of said plurality of manifold plates is formed by etching.

26. An inkjet head, comprising:

a plurality of ink pressure chambers, each of said ink pressure chambers selectively pressurizing ink supplied thereto to eject the ink from said inkjet head;

a manifold channel formed to be an annular looped channel and being in fluid communication with each of said ink pressure chambers to distribute the ink thereamong; and a plurality of ink supply channels connected to said manifold channel to supply ink from external ink supply to said manifold channel.

* * * * *